US011987328B2

(12) United States Patent
Aunvik et al.

(10) Patent No.: US 11,987,328 B2
(45) Date of Patent: May 21, 2024

(54) METHOD AND A SYSTEM FOR TRANSFERRING FLUID

(71) Applicant: Well Cleanup AS, Stavanger (NO)

(72) Inventors: Thomas Aunvik, Kleppe (NO); Roar Førland Riseth, Stavanger (NO)

(73) Assignee: Well Cleanup AS, Stavanger (NO)

( * ) Notice: Subject to any disclaimer, the term of this patent is extended or adjusted under 35 U.S.C. 154(b) by 117 days.

(21) Appl. No.: 17/801,319

(22) PCT Filed: Feb. 12, 2021

(86) PCT No.: PCT/NO2021/050041

§ 371 (c)(1),
(2) Date: Aug. 22, 2022

(87) PCT Pub. No.: WO2021/167467

PCT Pub. Date: Aug. 26, 2021

(65) Prior Publication Data

US 2023/0081116 A1 Mar. 16, 2023

(30) Foreign Application Priority Data

Feb. 21, 2020 (NO) ..... 20200224

(51) Int. Cl.
*B63B 27/34* (2006.01)
*E21B 43/013* (2006.01)

(52) U.S. Cl.
CPC ..... *B63B 27/34* (2013.01); *E21B 43/0135* (2013.01)

(58) Field of Classification Search
CPC ..... B63B 27/34; E21B 43/0135
See application file for complete search history.

(56) References Cited

U.S. PATENT DOCUMENTS 4,544,036 A 10/1985 Saliger
6,637,479 B1 * 10/2003 Eide ..... B63B 27/24 114/230.1
6,886,611 B2 * 5/2005 Dupont ..... B67D 9/00 414/139.4
9,309,739 B2 * 4/2016 Wright ..... E21B 33/038
(Continued)

FOREIGN PATENT DOCUMENTS

EP 2953846 10/2017
EP 2673457 11/2019
(Continued)

OTHER PUBLICATIONS

Norwegian Search Report for No. 20200224, dated Sep. 14, 2020.
(Continued)

*Primary Examiner* — Timothy L Maust
(74) *Attorney, Agent, or Firm* — Andrus Intellectual Property Law, LLP

(57) ABSTRACT

A method and a system for providing fluid communication between a floating vessel and an installation, wherein the method connects a guiding line to a male stab arranged at an end portion of a fluid transfer hose. The guiding line is operatively connected to a pulling device, such as a winch, forming part of a fluid transfer unit having a female receptacle. The guiding line runs through the female receptacle, and a portion of the guiding line is pulled through the female receptacle until the male stab connects to the female receptacle.

18 Claims, 17 Drawing Sheets

(56) References Cited

U.S. PATENT DOCUMENTS

| | | | | |
|---|---|---|---|---|
| 9,644,764 | B2 * | 5/2017 | Kelly | B67D 9/02 |
| 10,774,620 | B2 * | 9/2020 | Johnson | E21B 41/04 |
| 2003/0172991 | A1 | 9/2003 | de Baan | |
| 2004/0011424 | A1 | 1/2004 | Dupont et al. | |
| 2009/0295150 | A1 | 12/2009 | Dupont et al. | |
| 2011/0277845 | A1 | 11/2011 | Le Devehat et al. | |
| 2013/0025726 | A1 | 1/2013 | Dupont et al. | |
| 2013/0240085 | A1 | 9/2013 | Hallot et al. | |
| 2015/0001426 | A1 | 1/2015 | Thompson et al. | |
| 2019/0330960 | A1 | 10/2019 | Johnson | |

FOREIGN PATENT DOCUMENTS

| | | |
|---|---|---|
| WO | 01/34460 | 5/2001 |
| WO | 03/078244 | 9/2003 |

OTHER PUBLICATIONS

International Search Report and the Written Opinion for PCT/NO2021/050041, dated 4, 2021.
Response to the Written Opinion for PCT/NO2021/050041, dated Dec. 17, 2021.
The Second Written Opinion for PCT/NO2021/050041, dated Apr. 6, 2022.
International Preliminary Report on Patentability for or PCT/NO2021/050041, dated May 9, 2022.

* cited by examiner

METHOD AND A SYSTEM FOR TRANSFERRING FLUID

CROSS-REFERENCE TO RELATED APPLICATIONS

This application is the U.S. national stage application of International Application PCT/NO2021/050041, filed Feb. 12, 2021, which international application was published on Aug. 26, 2021, as International Publication WO 2021/167467 in the English language. The International Application claims priority of Norwegian Patent Application No. 20200224, filed Feb. 21, 2020. The international application and Norwegian application are both incorporated herein by reference, in entirety.

FIELD

The present disclosure is related to a fluid transfer system. More specifically, the disclosure is related to a method and a system for providing a fluid transfer system between a floating vessel and a fluid transfer unit arranged for example on an offshore installation, a ship, or a subsea installation. The fluid transfer unit may for example be an apparatus for communicating fluid into or out of a subsea well.

BACKGROUND

To provide a fluid transfer system between a floating vessel and a rig, between two vessels, or between a floating vessel and a subsea installation, a fluid line, such as a flexible hose, for transferring fluid must be interconnected therebetween. Prior to providing the fluid transfer system, the flexible hose is typically stored on a reel arranged on one of the vessel or rig. An end portion of the hose is provided with a coupling element configured for connection to a mating coupling element arranged on the fluid transfer unit.

For simplicity, the vessel that initially carries the hose is hereinafter denoted vessel, while the rig or vessel carrying the fluid transfer unit is denoted rig.

To provide fluid communication between the vessel and the rig, the coupling element arranged on the end portion of the hose, must be transferred from the vessel to the rig for connection to the mating coupling element provided on the fluid transfer unit on the rig. Hitherto, at least one crane has been used for moving the coupling element of the hose horizontally and vertically into abutment with the coupling element of the fluid transfer unit, whereupon the coupling elements are connected manually to provide the required fluid communication between the vessel and rig. This is a time-consuming method, and experiences indicate approximately 3 hours for each one of the connection operation and disconnection operation. However, due to safety regulations such an operation requires in at least some jurisdictions a so-called weather window for carrying out the operation. A weather window depends inter alia on planned time for the operation plus a so-called unforeseen time.

If the weather window is not available, the operation must be postponed. A postponed operation results in adding considerable costs to the operation. Further, in an emergency situation that requires disconnect of the fluid transfer system, a manual and time-consuming operation is required.

Publication 2013/025726 A1 discloses D4 a method and a system for transferring fluids between a barge, and a shuttle, according to which the shuttle is positioned at a predetermined distance from the barge and guides at least one flexible fluid transfer conduit from it to the shuttle. The shuttle is placed in a position wherein the shuttle is laterally offset from the barge while being essentially parallel to the longitudinal axis of the barge, and a fluid transfer system is provided, which enables the shuttle to be moved in the lateral and longitudinal directions in relation to the barge, during a transfer. A conveyance of hose tips from the barge to the shuttle is done using the cable, the free end of which is transported to the barge and fixed to a tip of guiding pin of a support assembly connected to the tips of the hoses and pulled into a guiding tube using the winch.

Publication US 2004/011424 A1 discloses a system for transferring a fluid product between a vessel and a fixed shore installation. The system comprises a connection device for connection to a manifold of the vessel and a flexible transfer pipe connected to shore installation. The connection device and the transfer pipe are configured for connected to each other via their free ends. At least the free end of the flexible transfer tube is operatively connected to a hoisting device to move said free end between a connection position to the connection device and a disengaged storage position. The free ends are provided with alignment means in the form of an alignment rod for mating with a trumpet, both of which are arranged substantially in parallel with but on the outside of said free ends.

Publication US 2019/330960 A1 discloses an ROV hot-stab device that is adapted to inject fluids into and extract fluids from a subsea line or a subsea equipment item.

Publication US 2015/001426 A1 discloses a stab connector for providing a fluid flow path between a first fluid reservoir and a second fluid reservoir.

There is therefore a need for a method and a system for providing the fluid transfer system independently of a weather window. Thus, there is a need for a method and a system that is independent of utilizing a crane, and a substantially automatic connection of the coupling elements on the hose and the fluid transfer unit. It is further a desire to provide a method and a system for automatically disconnected in an emergency situation.

The inventor has surprisingly found that a so-called hot stab disclosed in EP 2,673 457 B1 is suitable for forming a basis for a male coupling stab for connection to a leading end of the hose on the vessel. For simplicity, the male coupling stab will hereinafter also be denoted male stab.

EP 2,673 457 B1 discloses a male stab comprising a fixed part provided with at least one fluid port and a rotatable sleeve provided with at least one bore. By rotating the rotatable sleeve by means of a handle, the bore of the sleeve may be selectively brought into and out of fluid communication with the fluid port to allow and prevent fluid communication, respectively, through the stab.

SUMMARY

The invention has for its object to remedy or to reduce at least one of the drawbacks of the prior art, or at least provide a useful alternative to prior art.

The object is achieved through features, which are specified in the description below and in the claims that follow.

The invention is defined by the independent patent claims. The dependent claims define advantageous embodiments of the invention.

In a first aspect of the invention, there is provided a method for providing fluid communicating between a floating vessel and an installation by means of a fluid hose initially stored on the floating vessel, the fluid hose having a first end provided with a male stab, a second end for connection a fluid system of the floating vessel, and a valve for controlling fluid flow through the male stab, wherein the installation comprises a fluid transfer unit provided with:

- a female receptacle operatively connected to a fluid system of the installation;
- a valve for controlling fluid flow through the female receptacle; and
- a guiding line running through the female receptacle, the guiding line having a first end portion secured to a pulling device, and a second end portion for connection to the male stab;

the method comprising the steps of:

A) providing connection between the second end portion guiding line and the male stab;

B) activating the pulling device to pull a portion of the guiding line through the female receptacle and bring the male stab towards the female receptacle;

C) continue pulling the guiding line through the female receptacle until the male stab connects to the female receptacle; and D) opening the valves for fluid flow to allow fluid transfer through the hose between the floating vessel and the installation.

In one embodiment, the valve for controlling fluid flow through the male stab forms part of the male stab. In an alternative embodiment, the valve for controlling fluid flow through the male stab is arranged upstream of the male stab.

Preferably, the male stab is mechanically locked to the female receptacle when connected thereto by means of a locking device known per se.

Preferably, the valve for controlling fluid flow through the male stab is initially closed to avoid liquid ingress when transferring the male stab and the hose from the floating vessel to the installation. The liquid may typically be seawater.

In a first embodiment of the present invention, the offshore installation is a surface installation or a ship.

In a second embodiment of the present invention, the offshore installation is a subsea installation.

In the first embodiment wherein the offshore installation is a surface installation or a ship, step A) of the first aspect of the invention may comprise:

- connecting a first end portion of a pulling line to the male stab and transferring a second end portion of the pulling line to the fluid transfer unit; and
- connecting the second end portion of the pulling line to the guiding line.

By using a pulling device, typically a winch, comprising a guiding line running through the female receptacle, and connecting the pulling line to the guiding line, the hose can be connected to the fluid transfer unit without using a crane. This has the effect that fluid transfer system can be provided by means of the winch instead of a crane. A winch can normally be operated independently of a weather window. The only manual operation required by an operator is to connect the pulling line to the guiding line prior to winching the pulling line through the female receptacle and onto a spool of the winch.

The method may comprise providing the pulling line by means of a leading portion consti tuted by a rope, and a trailing portion, the trailing portion being connected to the male stab, the method comprises, transferring the leading portion from the floating vessel to the fluid transfer unit, and transferring the trailing portion of the pulling line to the installation by pulling the leading portion of the pulling line to the fluid transfer unit.

The transfer of the leading portion of the pulling line may be provided by means of a suitable apparatus, such as for example a so-called line thrower known per se, alternatively a drone or a boat if the weather conditions allow it. The leading portion may typically be a rope. By using a rope suitable for being transferred from the floating vessel to the fluid transfer unit arranged on a rig or a ship, i.e., another floating vessel, the trailing portion of the pulling line may for example be a wire having a high tensile strength.

The method may comprise disconnecting the leading portion of the pulling line from the trailing portion of the pulling line and connecting the trailing portion of the pulling line to the guiding line. Pulling in, for example by winching, the leading portion of the pulling line, which may typically be a rope, is thus avoided. This has the effect of a reduced wearing of the leading portion of the pulling line.

The connection between the male stab arranged on the leading end of the hose, and the female receptacle operatively connected to the fluid transfer unit may be provided by means of a quick coupling known per se.

The method may further comprise disconnection of the fluid transfer system by means of the following steps:

- closing at least the valve for controlling fluid flow through the male stab;
- releasing the male stab from the female receptacle;
- start feeding the pulling line from the pulling device and releasing the pulling line from the guiding line; and
- bringing the hose back onto the floating vessel.

In one embodiment, the step of bringing the hose back onto the floating vessel comprises winding the hose onto a reel on the floating vessel.

Closing at least the valve for controlling fluid flow through the male stab may further comprise closing also the valve for controlling fluid flow through the female receptacle.

In the second embodiment of the present invention wherein the offshore installation is a subsea installation, the method may for example be used for flowing stimulation fluid into a subsea well.

In the second embodiment of the invention, wherein the installation is a subsea installation, the second end portion of the guiding line may be connected to a buoyancy means, wherein the step A) of the first aspect of the invention may comprise:

- bringing the second end portion of the guiding line to a surface of the sea by allowing the buoyancy means to ascend to the surface;
- connecting the guiding line to the male stab; and
- disconnecting the buoyancy means from the guiding line.

Preferably, the pulling device is a winch, and the buoyancy means is allowed to ascend to surface by activating the winch to unspool a portion of the guiding line from the winch. Said portion of the guiding line being unspooled from the winch should at least correspond to a distance between the fluid transfer unit and male stab of the hose while carried by the floating vessel. The winch may be activated by a control signal communicated from the floating vessel to a remotely operated device forming part fluid transfer unit in a way and by means of equipment known per se. The method may further comprise closing at least the valve for controlling fluid flow through the male stab to prevent fluid flowing through the male stab; releasing the male stab from the female receptacle; and bringing the hose back onto the floating vessel. In one embodiment, the step of bringing the hose back onto the floating vessel comprises winding the hose onto a reel on the floating vessel.

Independently of the fluid transfer unit being at surface or subsea, the method may further comprise providing the female receptacle with an emergency disconnect system for disconnecting the male stab from the female receptacle. Such an emergency system may comprise providing a sensor apparatus configured for measuring a tension between the female receptacle and the male stab to measure tension form the hose, and configuring the sensor apparatus to issue a signal to a control system operatively connected to actuators for closing the valves for controlling fluid flow through the female receptacle and the male stab, and activating disconnect means of the female receptacle and the male stab, when a tension measured by the sensor apparatus exceeds a predetermined level, whereby the stab with the hose releases from the female receptacle.

The sensor apparatus may typically be a load cell.

In a second aspect of the invention there is provided a system for providing fluid communication between a floating vessel and an installation, such as an offshore surface installation, a ship or a subsea installation comprising a fluid transfer unit, the system comprising:

- a male stab for communicating a fluid, the male stab connected to a leading end of a hose configured for fluid communication with a fluid system on the floating vessel, and
- a valve for opening and closing for fluid communication through the male stab, wherein the system further comprising:
- a female receptacle operatively connected to the fluid transfer unit;
- a valve for controlling fluid flow through the female receptacle; and
- a guiding line running through the female receptacle, the guiding line having a first end portion secured to the pulling device, and a second end portion for connection to the male stab so that the male stab, when connected to the guiding line, is guided into mating contact with the female receptacle by means of the guiding line running through the female receptacle.

The female receptacle may comprise a locking device for locking the male stab with respect to the female receptacle.

The trailing end of the hose is typically connected to a fluid system being in fluid communication with a fluid receptacle on the floating vessel.

An end portion of the male stab may be provided with a quick release configured for disconnect from the end portion of the male stab in a controlled disconnect, the quick release further comprising a quick release connector for connecting to an end portion of the guiding line, the quick release connector being configured for disconnect from the quick release in an emergency situation so that the guiding line is disconnected from the quick release and the male stab when the quick release connector is activated to disconnect.

This has the effect that no unwinding of the guiding line is required.

In one embodiment is the second end portion of the guiding line connected to the male stab by means of a pulling line. In this embodiment, an end portion of the male stab may be provided with a quick release configured for disconnect from the end portion of the male stab in a controlled disconnect, the quick release further comprising a quick release connector for connecting to an end portion of the pulling line, the quick release connector being configured for disconnect from the quick release in an emergency situation so that the pulling line is disconnected from the quick release and the male stab when the quick release connector is activated to disconnect. This has the effect that the pulling line remains on the pulling device, such as a winch, of the fluid transfer unit, and no feeding out or unwinding of the pulling line is required, and no manual disconnecting of the pulling line from the guiding line is required.

The quick release may be activated to disconnect from the male stab by means of a release actuator being responsive to an activation signal from a control system arranged in connection with the fluid transfer unit. The control signal may typically be initiated by an operator. Further, the quick release connector may be activated to disconnect from the quick release by means of a release actuator being responsive to an activation signal from a senor, as will be discussed below. The quick release and the quick release connector may in one embodiment be of a type known per se, for example as disclosed in EP 2,673,457 B1.

In one embodiment, the activation signal may be initiated by an operator. Alternatively, or additionally to an operator initiated activating signal, the activation signal may be provided by a sensor apparatus configured for measuring a tension between the female receptacle and the male stab to measure tension from the hose, the sensor configured to issue a signal to the control system operatively connected to a valve actuator for closing at least the valve of the male stab, alternatively the valve for controlling fluid flow through the male stab, and the release actuator for activating disconnect of the quick release connector when a tension measured by the sensor apparatus exceeds a predetermined level, whereby the quick release and male stab with the hose, releases from the quick release connector still being connected to the female receptacle. The sensor may typically be a load cell.

Providing a valve actuator for closing the valve of the male stab, alternatively the valve for controlling fluid flow through the male stab, by means of a signal from a control system has the effect that any fluid in the hose is prevented from discharging when the stab releases from the quick connector. Any spill of fluid within the hose may thereby be prevented. Preferably, the valve of the stab is closed before the stab is released.

Preferably, the valve for controlling fluid flow through the female receptacle is also provided with an actuator for controlling opening and closing of the valve.

An advantage of also closing the valve for controlling fluid flow through the female receptacle, is that spill of fluid flowing in the fluid transfer system is at least substantially prevented. When also the valve for controlling fluid flow through the female receptacle is activated by means of an actuator being response to a control signal from the control system, the valve is preferably closed substantially simultaneously with the valve in or at the male stab.

To facilitate correct axial orientation of the male stab with respect to the female recepta cle, the female receptacle and the stab may be provided with orientating means.

Preferably, independently of being arranged on a fluid transfer unit arranged on a surface installation or a subsea installation, the female receptacle comprises a gimbal for facilitating connection between the female receptacle and the male stab when a longitudinal axis of the male stab and a longitudinal axis of the female receptacle are inclined with respect to each other. For a surface installation or a ship, this has the effect that the gimbal may allow vertical orientation of the female receptacle even if the fluid transfer unit is inclined due to for example an ocean swell heeling the installation. Further, the gimbal may also facilitate connection between the male stab and the female receptacle in a situation where the male stab is subject to a sideway drag caused for example by a drift of the vessel. Such a sideways drag may result in a longitudinal axis of the male stab being inclined with respect to a longitudinal axis of the female receptacle. For a surface installation, a longitudinal axis of the female receptacle will typically be vertical.

BRIEF DESCRIPTION OF THE DRAWINGS

In the following is described an example of preferred embodiments illustrated in the accompanying drawings, wherein.

DETAILED DESCRIPTION OF THE DRAWINGS

Figure 1A:
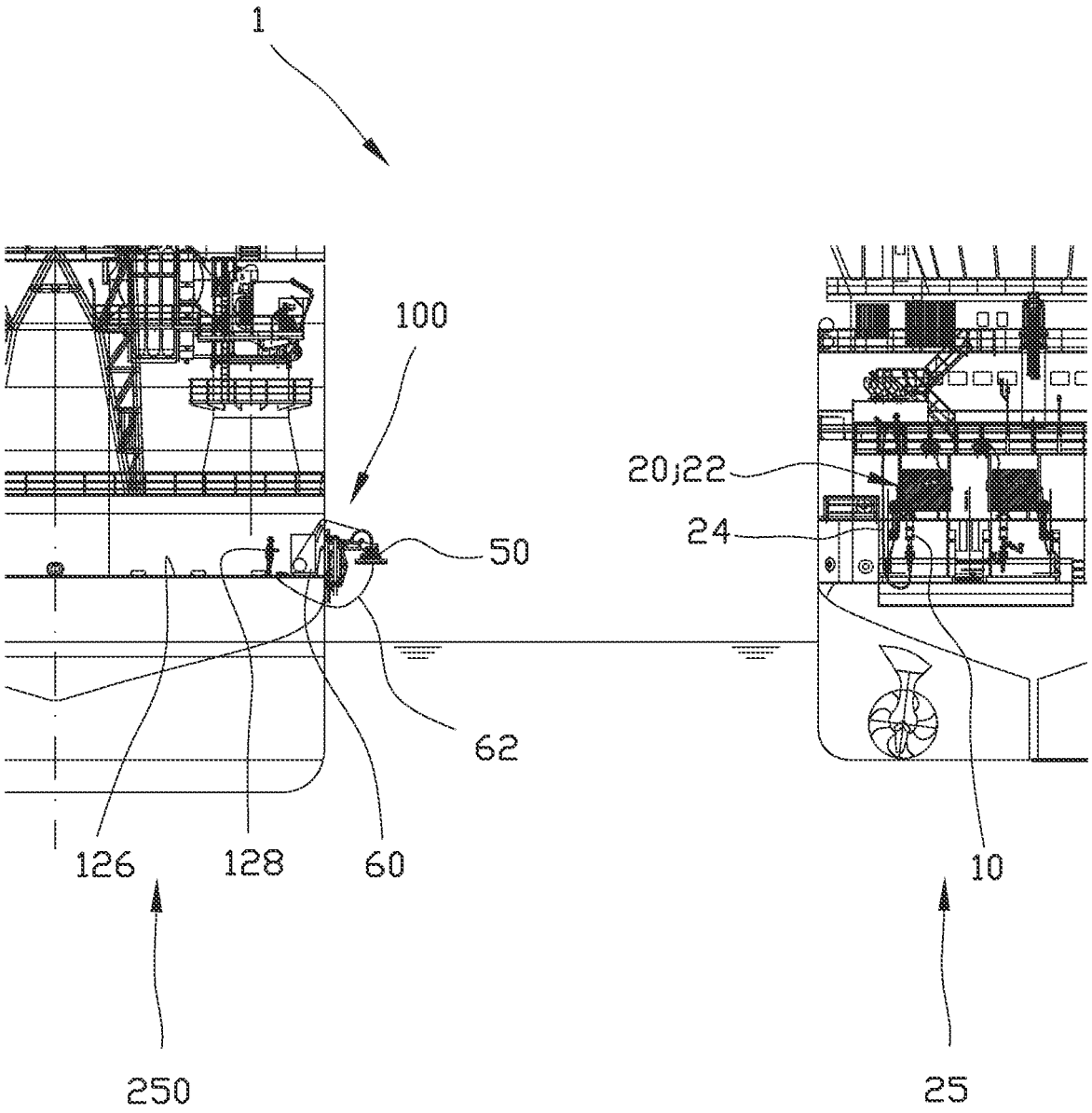
FIG. 1*a* shows of portion of a floating vessel provided with a hose comprising a male stab forming part of the present invention, the floating vessel being adjacent an offshore surface installation in the form of a ship comprising a fluid transfer unit.

Any positional indications refer to the position shown in the figures.

In the figures, same or corresponding elements are indicated by same reference numerals. For clarity reasons some elements may in some of the figures be without reference numerals.

A person skilled in the art will understand that the figures are just principle drawings. The relative proportions of individual elements may also be strongly distorted.

In the figures reference numeral 1 denotes a system according to the present invention. The system 1 comprises a male fluid stab 10 connectable to a female receptacle 50 forming part of a fluid transfer unit 100.

The male stab 10 is provided with a valve for opening and closing for fluid communication.

In a prototype of the system 1, the male stab 10 is substantially as disclosed in EP 2,673,457 B1 to the company Blue Logic AS, Sandnes, Norway. The male stab 10 is connected to a leading end of a hose 20 connected to a spool 22 arranged on the floating vessel 25. A trailing end of the hose 20 is typically connected to a fluid line or a fluid reservoir (neither shown) in the floating vessel 25, so that a fluid can be communicated to or from the floating vessel 25 via the stab 10 and hose 20, and said fluid line or fluid reservoir.

The female receptacle 50 is operatively connected to and forms part of the fluid transfer unit 100. The fluid transfer unit 100 in FIGS. 1*a*-1*h* is arranged on an installation 250, such as for example an offshore installation, a drilling rig, a ship, while the fluid transfer unit 100 in FIGS. 3*a*-3*i* is a subsea installation.

A ship may typically be an FPSO-vessel (FPSO-Floating Production, Storage and Of-floading). A fluid transfer unit 100 in the form of a subsea installation may typically comprise a subsea hose transfer system, SHTS.

As best seen in FIGS. 1*a*-2*c*, the female receptacle 50 is provided with a valve 51 (see FIGS. 2*a*-2*c*) for opening and closing for fluid communication through the receptacle 50. The female receptacle 50 is operatively connected to a pulling device, here in the form of a winch 60 forming part of the fluid transfer unit 100. The winch 60 is capable of hoisting the male stab 10 arranged on the leading end of the hose 20 out of the water and into mating contact with the female receptacle 50.

An embodiment of a method for providing a fluid transfer system between a floating vessel 25 and a fluid transfer unit 100 arranged on a floating installation 250, is shown in great principle in FIGS. 1*a* to 1*f*.

In FIG. 1*a* the floating vessel 25 is positioned at a safe distance from an installation, here shown as a ship 250, for example an FPSO. A safe distance may typically be minimum 80*m*. The floating vessel 25 holds a hose 20 wound on a spool 22. A male stab 10 is connected to a leading end portion of the hose 20. A pulling line 24 is connected to an end portion of the stab 10. In the embodiment shown, the pulling line 24 extends from the male stab 10 to a deck 26 of the floating vessel 25 wherein the pulling line 24 is stored prior to being transferred to the ship 250 as shown in FIG. 1*b*.

Figure 1B:
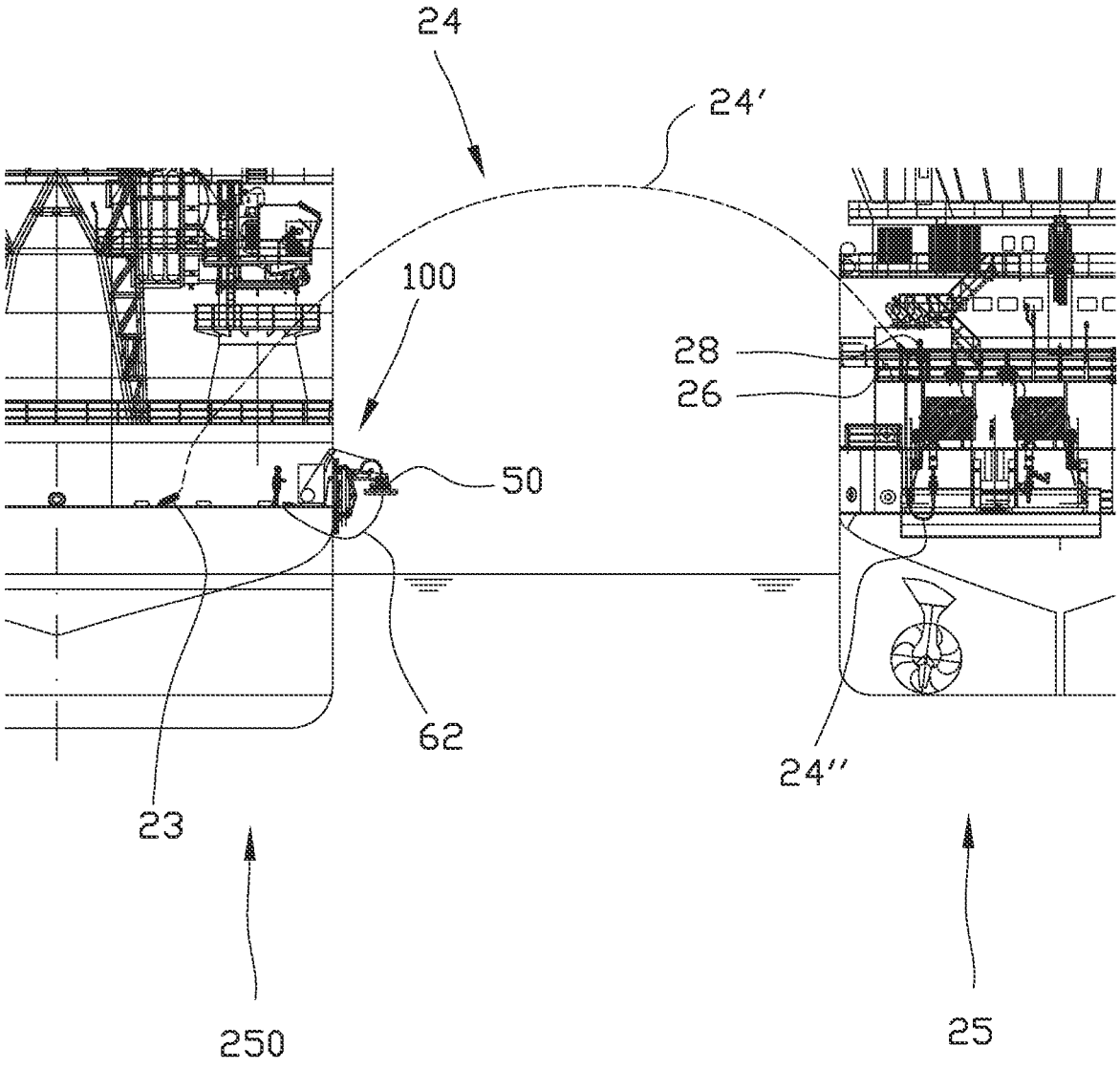
FIG. 1*b* shows an initial step of transferring a rope from the floating vessel to the offshore installation.

In FIG. 1*b*, an operator 28 on the deck 26 of the floating vessel 25 transfers an end portion of the pulling line 24 to an operator 128 being on a deck 126 on the ship 250, close to the fluid transfer unit 100. The pulling line 24 is typically transferred by means of a pneumatically operated line thrower commercially available in the marked.

The pulling line 24 may advantageously have a leading portion 24' in the form of a rope suitable for being thrown by the line thrower, and a trailing portion 24" providing a connection between the leading portion 24' and the male stab 10. By using a rope suitable for being thrown by a line thrower from the floating vessel 25 to the ship 250, the trailing portion 24" may for example be a wire having a high tensile strength. A leading end portion of the rope 24' is provided with a mass 23, made for example of plastic or another suitable material, to receive kinetic energy from the line thrower for "dragging" the rope 24' from the vessel 25 to the ship 250.

Figure 1C:
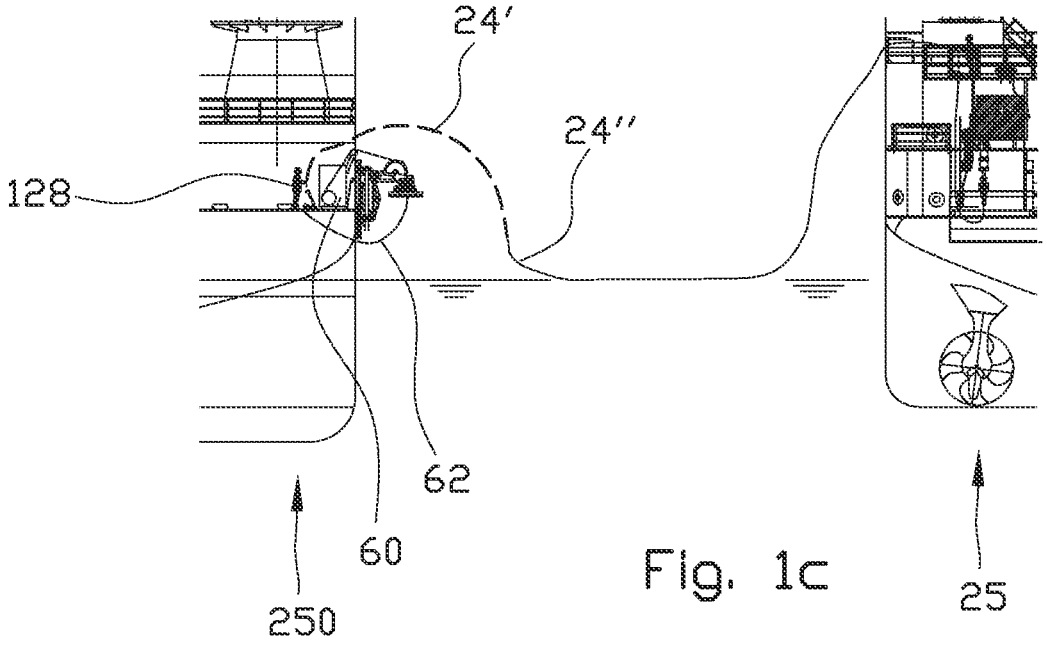
FIG. 1*c*-1*f* show in a larger scale further steps of the method according to the invention for providing the fluid control system.
Figure 1D:
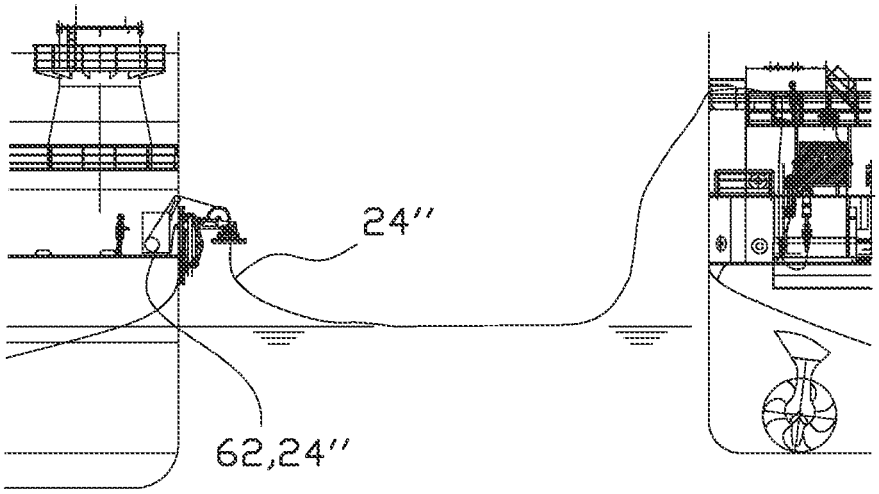

In FIG. 1*c*, the operator 128 on the ship 250 pulls the leading portion 24' (shown by dotted line) by hand until the trailing portion 24" reaches the operator 128. Then, the leading portion 24' is disconnected from the trailing portion 24". Thereafter, the trailing portion 24" is connected to a guiding line 62 operatively connected to the winch 60 of the fluid transfer unit 100, as shown in FIG. 1*d*. Spooling of the guiding line 62 and the trailing portion 24" of the pulling line 24 onto a drum of the winch 60 is then commenced.

Figure 1E:
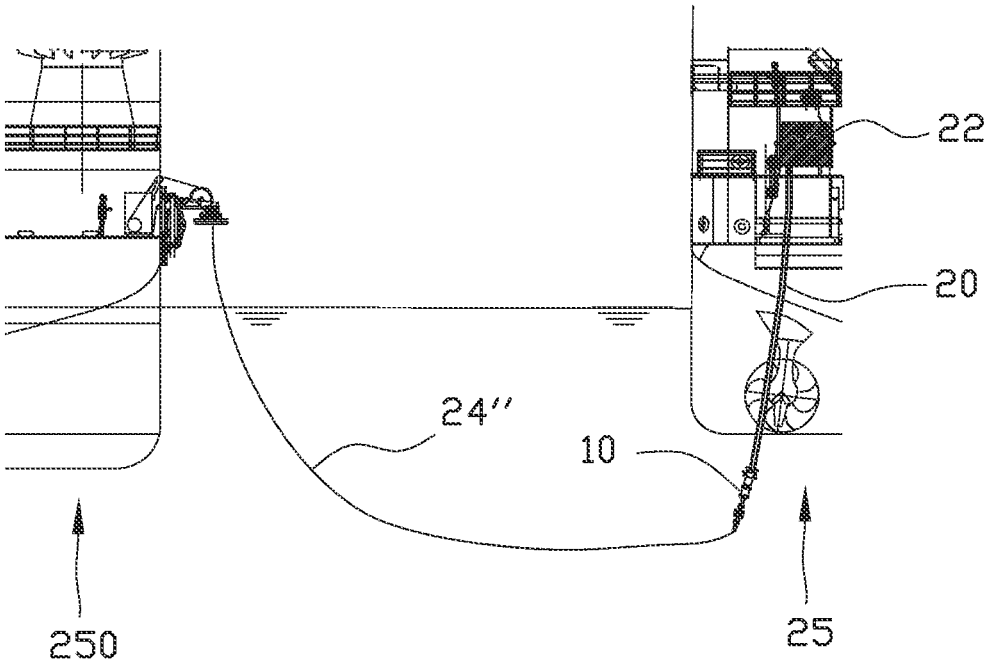
Figure 1F:
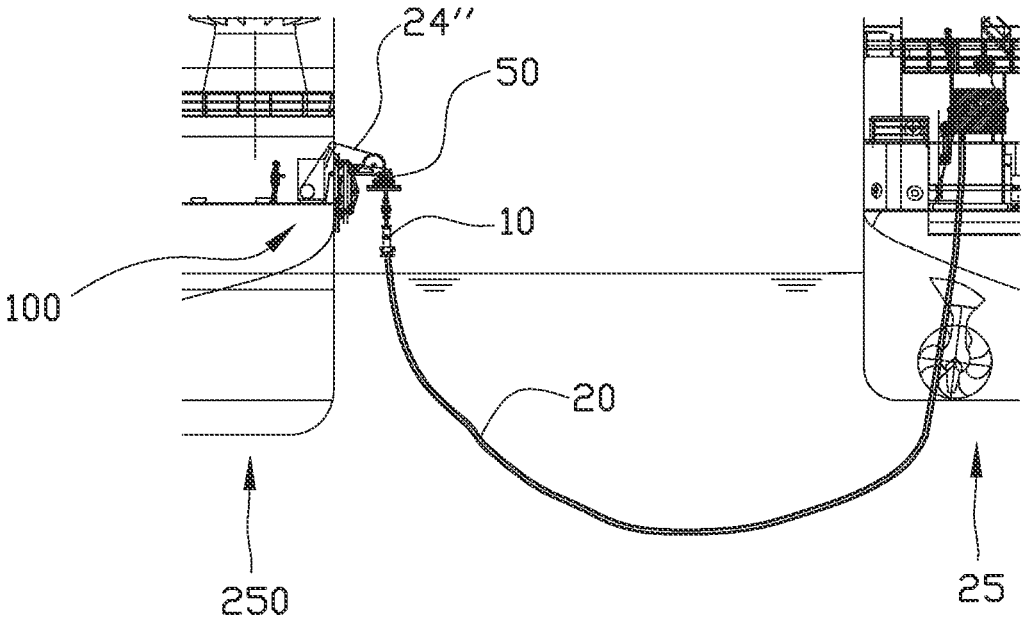

In FIGS. 1*e* and 1*f*, the feeding out of the hose 20 from the spool 22 on the floating vessel 25 has commenced. Feeding the hose 20 from the spool 22 continues until the male stab 10 has been brought into contact with the female receptacle 50 of the fluid transfer unit 100, as shown in FIG. 1*f*.

By opening valves in the male stab 10 and in the female receptacle 50, a fluid can be communicated in a desired direction between the floating vessel 25 and the fluid transfer unit 100. A great advantage of the method disclosed herein is that the fluid communication between the floating vessel 25 and the fluid transfer unit 100 is provided without using a crane and a time-consuming manual connection carried out by an operator, as has hitherto a common method for providing a fluid transfer system. The connection operation disclosed herein is therefore substantially independent of a weather window. The only manual operations consist substantially in transferring the pulling line 24 and connecting the pulling line 24 to the guiding line 62 operatively connected to the winch 60.

FIGS. 1*g*-1*j* show a controlled disconnect operation.

Figure 1G:
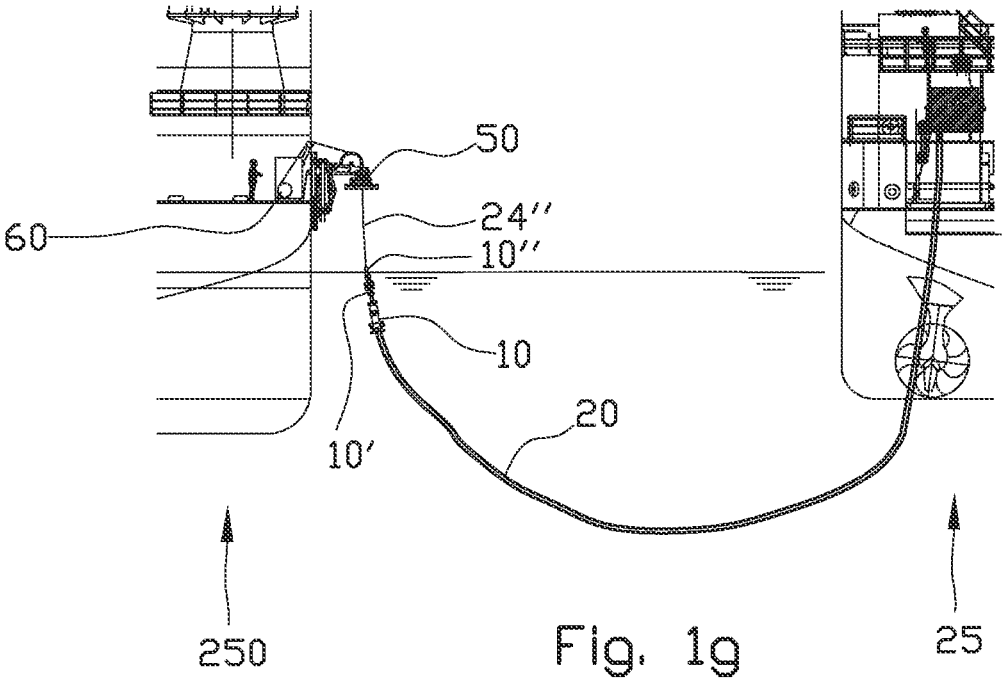
FIGS. 1*g*-1*j* show principle steps of the method according to the invention for controlled disconnect of the fluid transfer system.
Figure 1H:
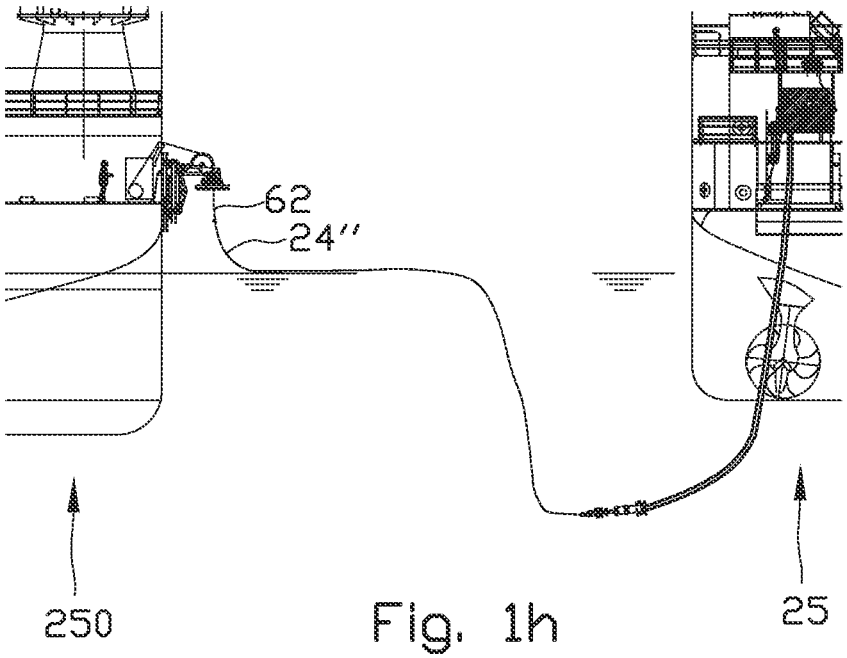

In FIGS. 1*g*, the male stab 10 has been released from the female receptacle 50 and lowered into the sea by feeding the pulling line 24 (here the trailing 24" portion) out from the winch 60. This operation continues in FIG. 1*h* until a connection between the trailing portion 24" of the pulling line 24 and the guiding line 62 is below the receptacle 50. Then the connection is disconnected. In FIG. 1*h*, the pulling line 24 has been disconnected from the guideline 62 of the winch 60 and spooling of the hose 20 onto the spool 22 on the floating vessel 25 has commenced. It should be noted that the pulling line 24 is illustrated as a floating rope.

Figure 1I:
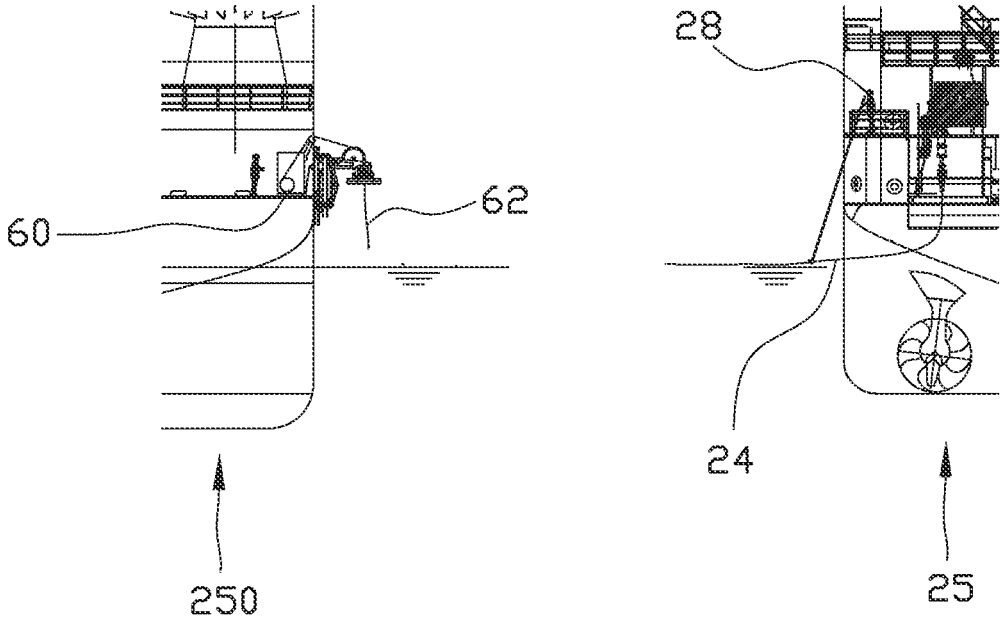
Figure 1J:
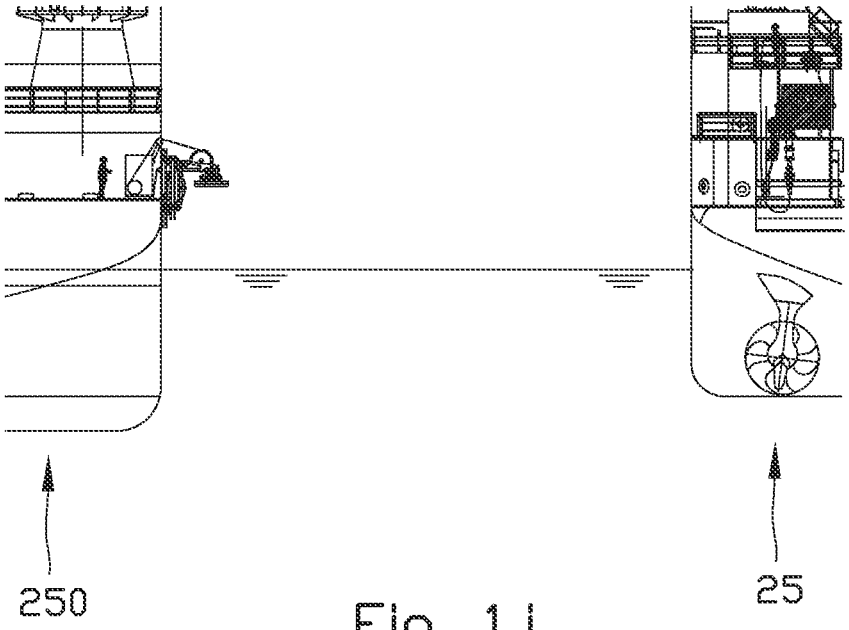

In FIG. 1*i*, an operator 28 collects a portion of the floating pulling line 24, and in FIG. 1*j* the system is prepared for commencing a new operation or the floating vessel 25 is ready for departure.

Figure 1K:
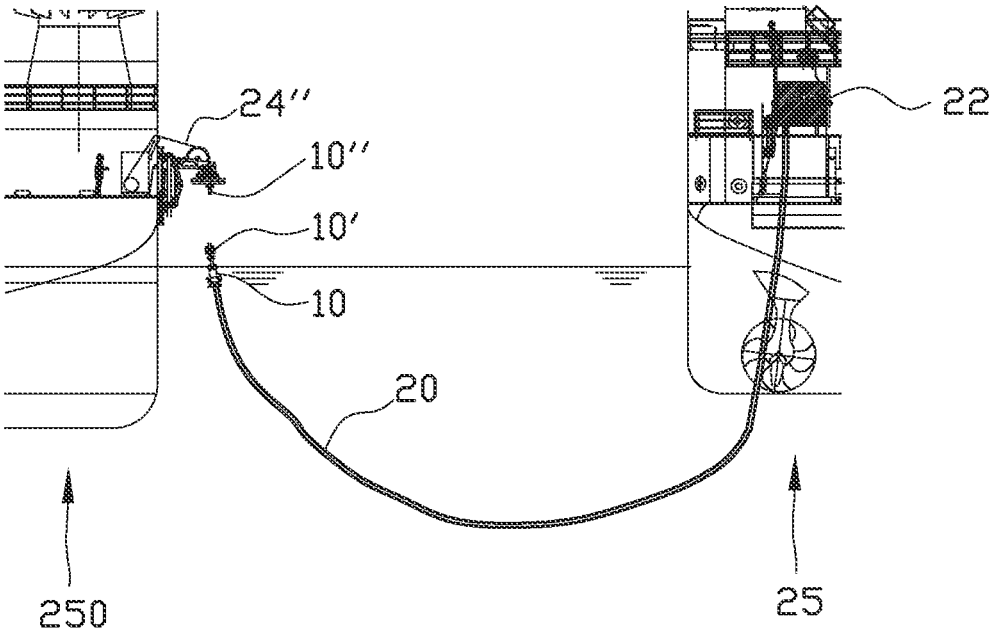
FIG. 1*k*-1*l* show a principle method according to the invention wherein a quick lease has been activated.
Figure 1L:
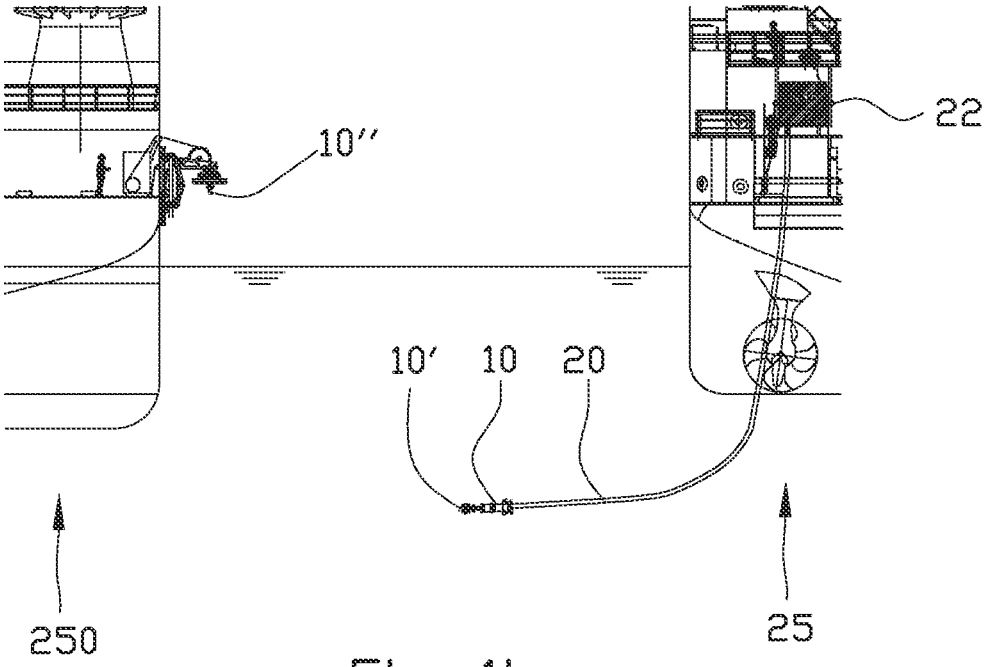
Figure 1M:
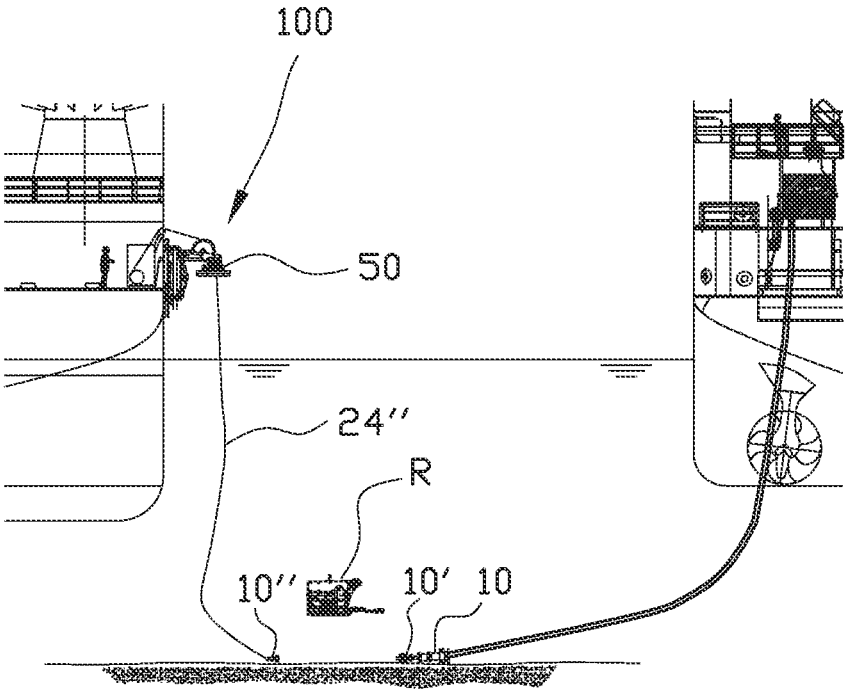
FIG. 1*m* shows an ROV prior to connecting a male stab to a pulling line lowered to a sea floor.

FIGS. 1*k* and 1*l* show an embodiment wherein the system 1 comprises a quick release as will be discussed in more details below. In FIG. 1*k*, the male stab 10 has been disconnected from a quick release connector 10" connected to the trailing portion 24" of the pulling line 24 instead of feeding out the pulling line 24" from the winch 60 and disconnecting the pulling line 24 from the guiding line 62 as indicated in FIGS. 1*i*-1*j*. A quick release operation without any unwinding of the pulling line 24" may be important in an emergency disconnect situation. Subsequent an emergency disconnect operation as indicated in FIG. 1*k*, the male stab 10 is no longer connected to the quick release connector 10" and the pulling line 24" which remains operatively connected to the fluid transfer unit 100.

In one embodiment, the fluid transfer unit 100, further comprises a cutting device (not shown) configured for cutting the pulling line 24 between the female receptacle 50 and the winch 60 so that the male stab 10 and any quick release 10' and quick release connector 10" are released from the female receptacle 50. The cutting device may for example be a guillotine-arrangement known per se. A primary purpose of such a cutting device is to provide back-up safety system should the activation of the quick release connector 10" fail. The cutting device may for example be a guillotine apparatus known per se.

FIG. 11 shows one way of re-connecting the pulling line 24" to the male stab 10 by using an ROV R (ROV—Remotely Operated Vehicle). The pulling line 24" with the quick release connector 10" has been lowered to the sea floor. The quick release connector 10" is then coupled to the quick release 10' which is connected to the male stab 10, by means of the ROV R, whereupon the pulling line 24" with its quick release coupling 10", quick release 10' and the male stab 10 are hoisted to the fluid transfer unit 100, until the male stab 10 is reconnected to the female receptacle 50.

Figure 1N:
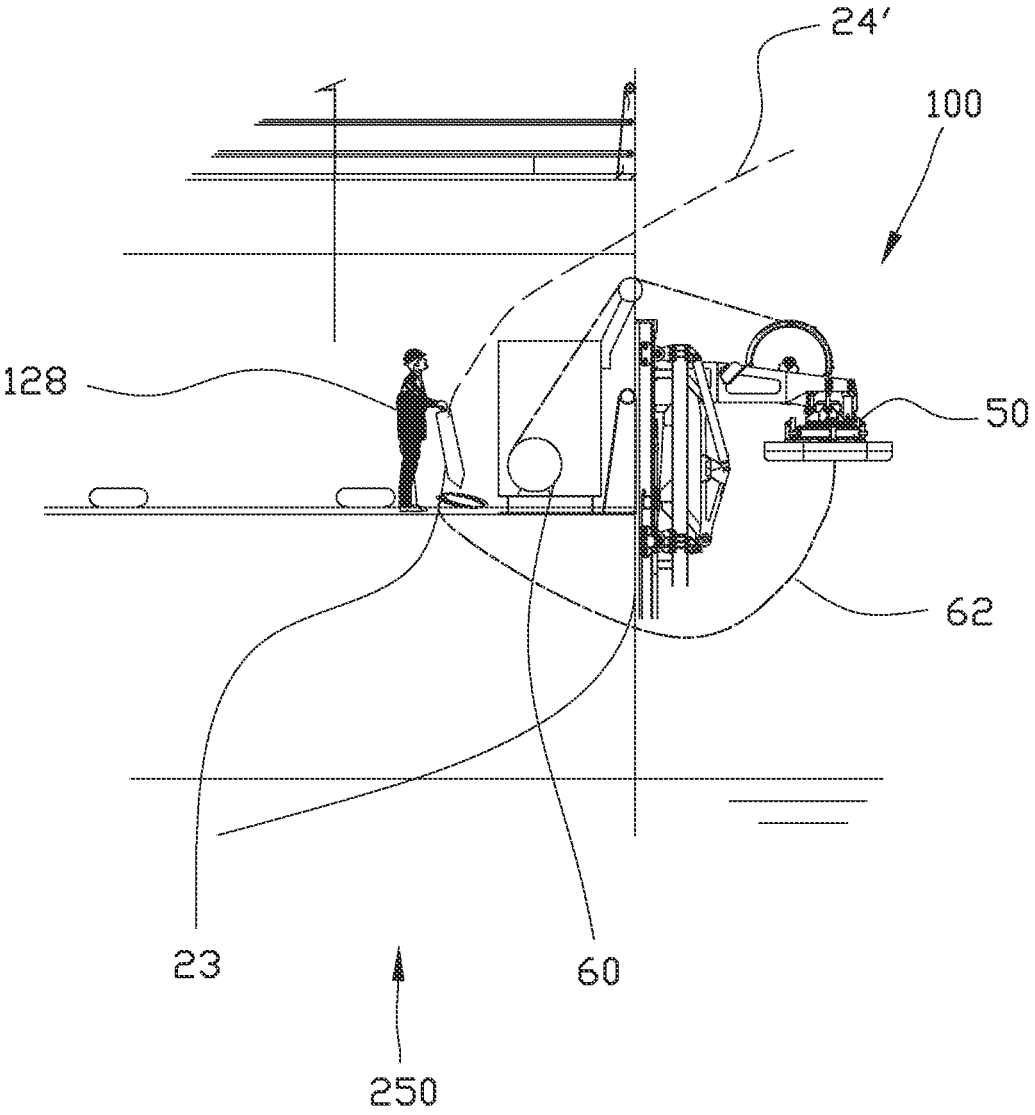
FIG. 1*n* shows in larger scale a detail wherein an operator connects a pulling line to a guiding line operatively connected to the fluid transfer unit.

FIG. 1*n* shows in larger scale a detail of the fluid transfer system 100 when the operator 128 is in the process of connecting the trailing portion 24' of the pulling line 24 to the guiding line 62 of the winch 60. This operation is carried out between the steps illustrated in FIGS. 1*c* and 1*d*.

Figure 2A:
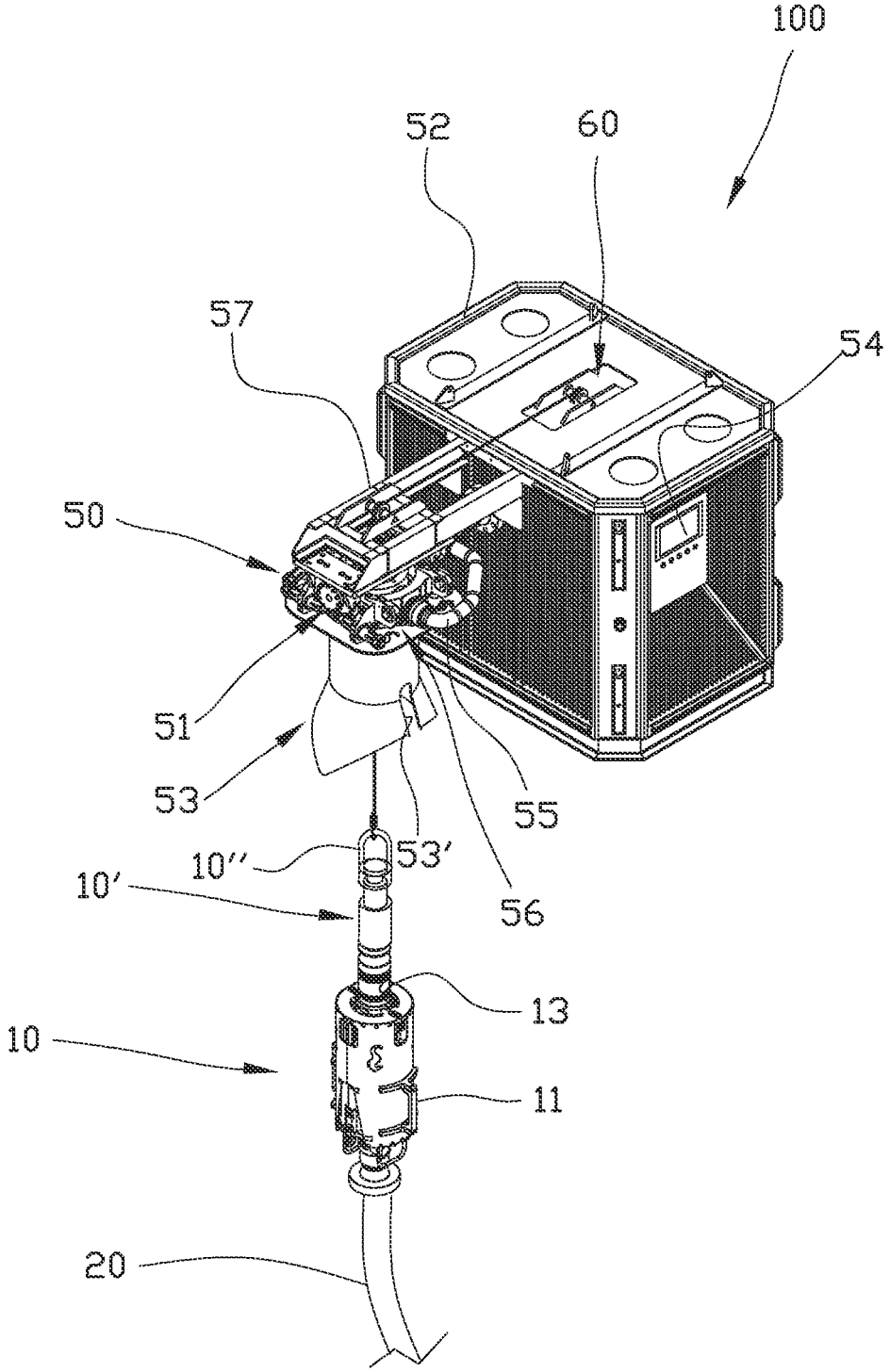
FIGS. 2*a*-2*c* show in larger scale a male stab connected to a leading end of a hose, being hoisted towards a female receptacle operatively connected to a fluid transfer unit.
Figure 2B:
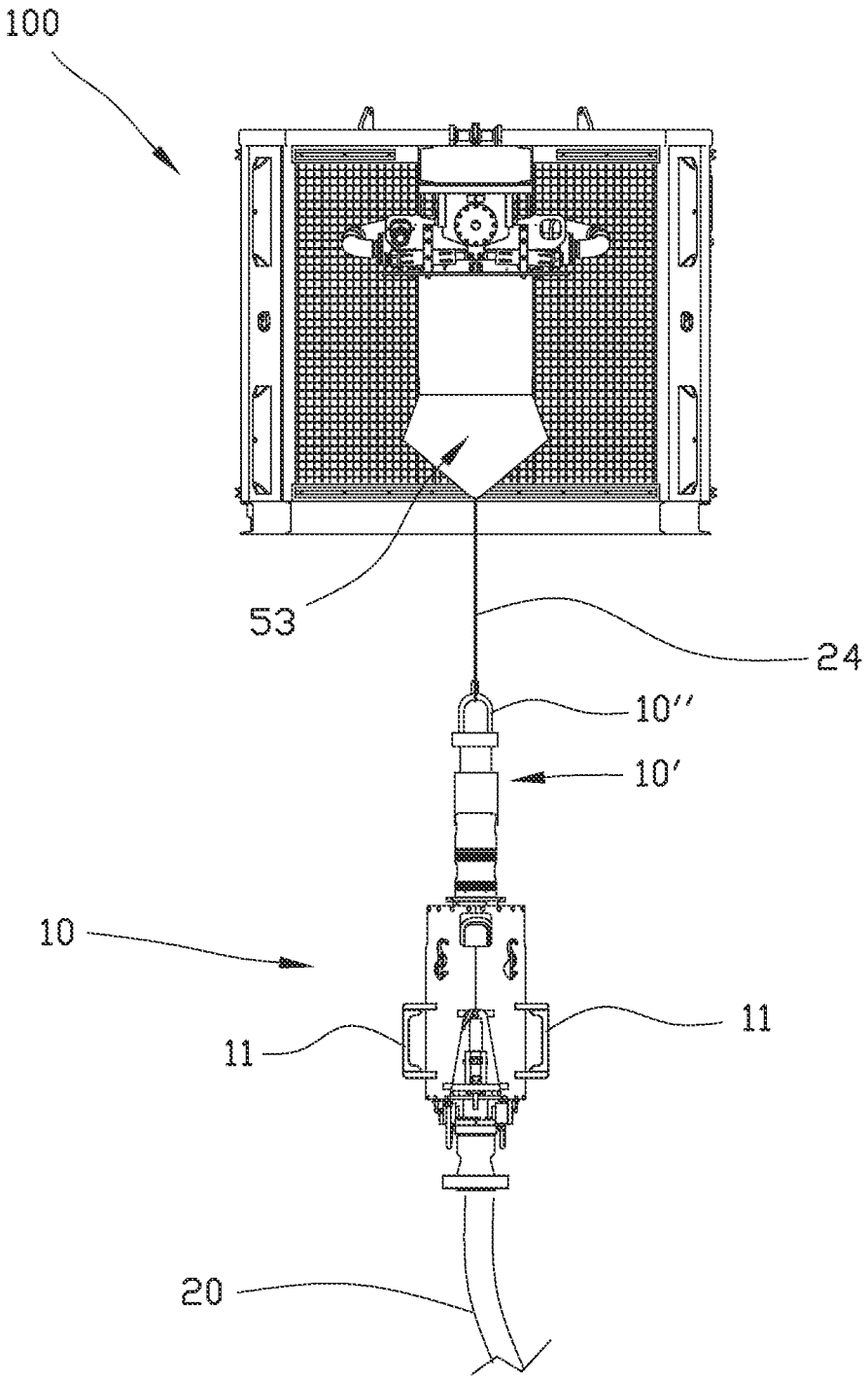
Figure 2C:
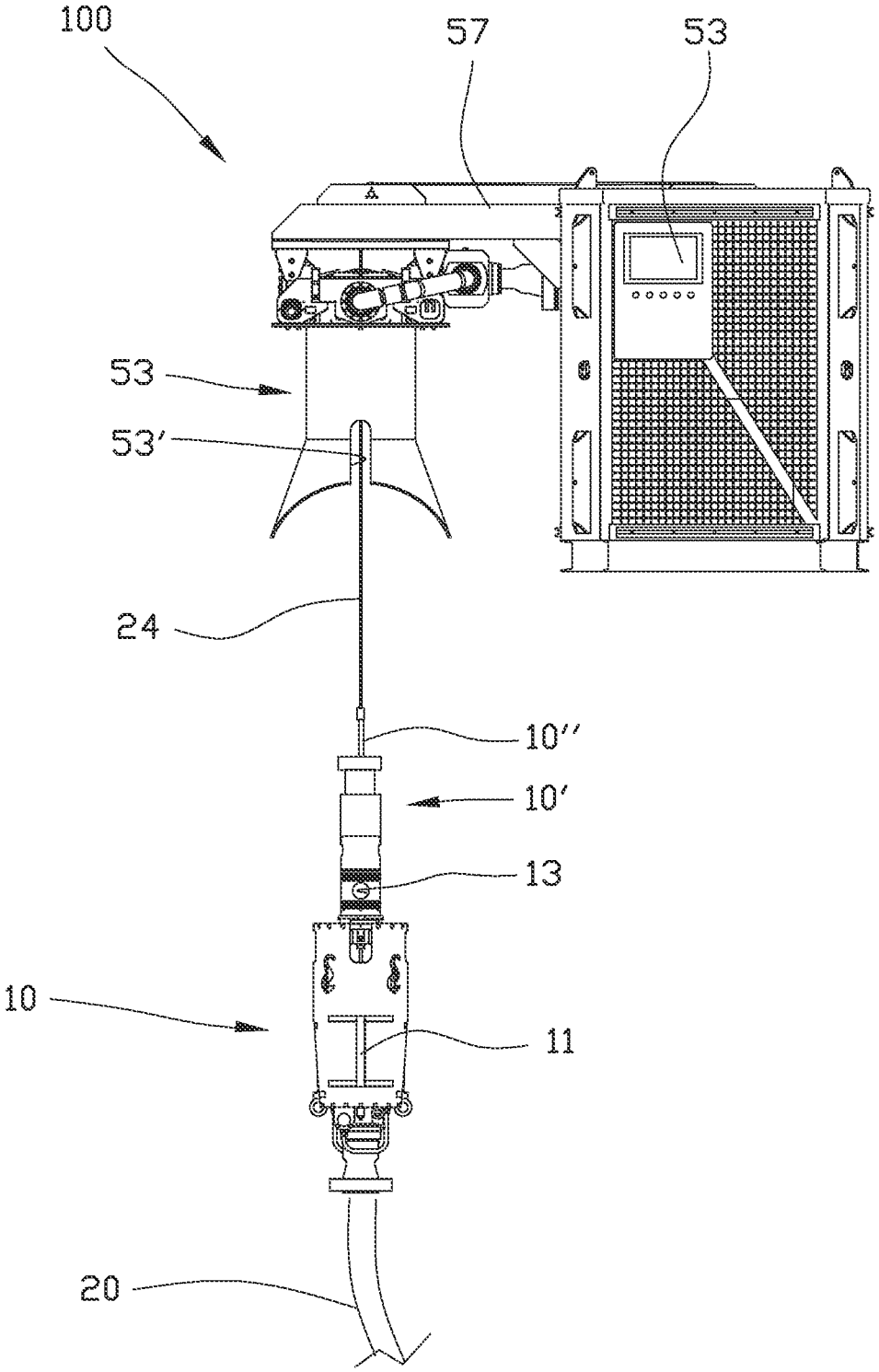

Turning now to FIGS. 2*a*-2*c*, showing parts of the system 1 in more details, and with features not shown in the very principle drawings 1*a*-1*n*.

FIGS. 2*a*-2*c* show in a larger scale a perspective view and side views, respectively, details of the male stab 10 being hoisted towards the female receptacle 50 forming part of the fluid transfer unit 100. It should be noted that the fluid transfer unit 100 shown in FIG. 2*a*-2*c* has a different configuration than that indicated in FIGS. 1*a*-*n*, but the operating principle is the same.

The female receptacle 50 is operatively connected to a frame 57 cantilevered from a cabinet 52 comprising the winch 60, a control system and an operator panel 54 for controlling the fluid transfer unit 100 and valve actuators for operating the valve 51 of the female receptacle 50 and also the valve of the male stab 10.

The female receptacle 50 comprises a funnel 53 provided with a recess 53' configured for receiving a guide bar 11 of the male stab 10 so that the male stab 10 is correctly oriented with respect to the female receptacle 50 to allow fluid communication between an aperture 13 in the male stab 10 and a fluid pipe 55 of the female receptacle 50. The fluid pipe 55 is in fluid communication with a fluid system of the installation 250 shown for example in FIG. 1*a*.

The female receptacle 50 is provided with a gimbal 56 to allow some skewing of the female receptacle 50 with respect to the frame 57 extending from the cabinet 52. The gimbal 56 may allow vertical orientation of the female receptacle 50 even if the cabinet 52 and the frame 57 are inclined due to for example an ocean swell heeling the installation 250 shown for example in FIG. 1*a*. Further, the gimbal 56 may also facilitate connection between the male stab 10 and the female receptacle 50 in a situation where the male stab 10 is subject to a sideway drag caused for example by a drift of the vessel 25 (shown in FIGS. 1*a*-1*m*). Such a sideways drag may result in a longitudinal axis of the male stab 10 being inclined with respect to a vertical direction.

To monitor a load from the male stab 10 and the hose 20 connected thereto, the gimbal 56 is provided with a sensor in the form of a load cell. The load cell communicates with the control system of the fluid transfer unit 100. If a tension measured by the sensor exceeds a predetermined level, the control system is configured to issue a signal to the actuators for controlling the valves of the male stab and the female receptacle 50 to a closed position, and activating disconnect of a quick release 10' operatively connected to the male stab 10. The purpose of the quick release connector 10" is to disconnect from the quick release 10', and thus the male stab 10 with the hose 20, while the quick release connector 10" and guiding line 24" connected to a quick release connector 10" still being connected to the female receptacle 50. By closing the valves of the female receptacle 50 and the male stab 10 automatically when the load cell measures a tension above a predetermined level, and before the quick release connector 10" is activated to disconnect, there will be substantially no spill of fluid even if fluid is flowing in any direction between the vessel 25 and the installation or ship 250.

Preferably, the system comprises two types of quick release systems, hereinafter denoted emergency quick disconnect, EQD, namely an electronic EQD and a mechanical EQD.

The electronic EQD function are triggered by signals from the load cell. The load cell constantly sends weight/tension information to the control system within the fluid transfer unit 100.

An integrated program will activate signals to the EQD if a pre-programmed tension value is exceeded, and activate disconnect of the quick release connector 10".

In one embodiment, the EQD further comprises audible and/or visual alarms which will be activated by the control system to notice the operator that tension measured by the load cell is close to reaching the pre-set value. An operator can then decide whether to activate the EQD manually via the control panel 54.

The mechanical EQD is fully mechanical and will function as a redundant or back-up system in case of power failure or similar occurs on the control system. The mechanical EQD shall be adjusted to release if the load cell measures a tension exceeding the pre-set value.

The mechanical EQD is configured to close the valves on both male stab 10 and the female receptacle 50 before the quick release connector 10" is activated to disconnect.

The quick release 10' and the quick release connector 10" themselves and the operation thereof is of a type known per se.

Turning now to the embodiment shown in FIGS. 3*a*-3*j* showing an embodiment wherein the installation 250 is arranged subsea on a seafloor S. The installation 250 comprises a so-called X-mas tree 252 for providing flow control on an oil or gas well. A X-mas tree operate with the wellhead WH to control the flow of production or injection fluids and also connect tubing and other devices in the well to the seafloor S and facilities above water.

The installation 250 comprises a fluid transfer unit 100 having similar features as the fluid transfer unit 100 as discussed as regards FIGS. 1*a*-2*c*. The fluid transfer unit 100 has been installed adjacent the X-mas tree 252 typically by means of a so-called IMR vessel (IMR—Inspection, Maintenance and Repair). After installation of the fluid transfer unit 100, a connection hose 150 for providing fluid communication between the fluid transfer unit 100 and the X-mas tree 252, has been installed, typically by means of an ROV (Remotely Operated Vehicle) operated from the IMR-vessel. Such operations will be known to a person skilled in the art and will therefore not be discussed in further details in this document.

A main purpose of the FIGS. 3*a*-3*j* is to illustrate in great principle the steps of connecting a hose 20 stored on a spool 22 on a floating vessel 25, to the subsea fluid transfer unit 100.

Figure 3A:
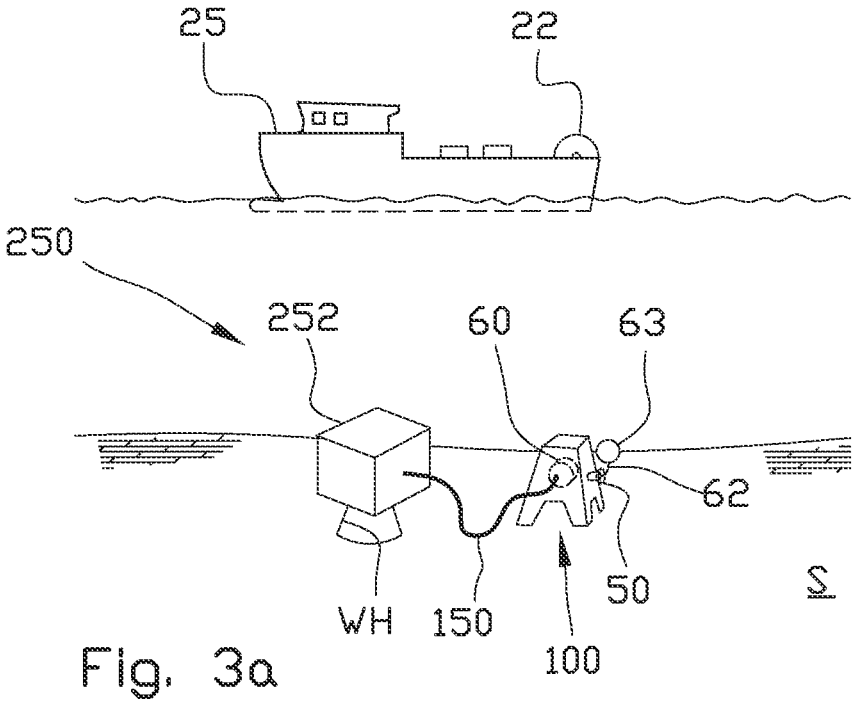
FIGS. 3*a*-3*i* show principle steps of transferring a rope from the floating vessel to an offshore subsea installation.

In FIG. 3*a*, the floating vessel 25 has arrived at an offshore location above the subsea installation 250. It should be noted that a distance between the installation 250 and the surface of the sea may be several hundred meters, as will be appreciated by a person skilled in the art. The vessel 25 may typically be a so-called stimulation vessel carrying stimulation fluid for use in a well. The fluid transfer unit 100 comprises a female receptacle 50 and is operatively connected to the X-mas tree 252 of the installation 250 by means of the connection hose 150. In the illustrated embodiment, the receptacle has a longitudinal axis being substantially horizontal, i.e., configured for receiving a male stab 10 being oriented with a longitudinal axis being substantially horizontal. However, it should be noted that the longitudinal axis of the female receptacle may be vertical or any angle between horizontal and vertical. The fluid transfer unit 100 is provided with a valve arrangement (not shown) for controlling fluid flow through the receptacle 50. The fluid transfer unit 100 further comprises a pulling device, here in the form of a winch 60 (indicated by dotted line in FIG. 3*a*). The winch 60 is arranged within a portion of the fluid transfer unit 100 and has a guiding line 62 running through the female receptacle 50. The guiding line 62 has a first end portion secured to the winch 60 and a second end portion for connection to the male stab 10 of the hose 20 (see FIG. 3*d*).

In FIG. 3*a* the second end of the guiding line 62 is connected to a buoyance means, here shown as a buoy 63 initially located adjacent the female receptacle 50.

Figure 3B:
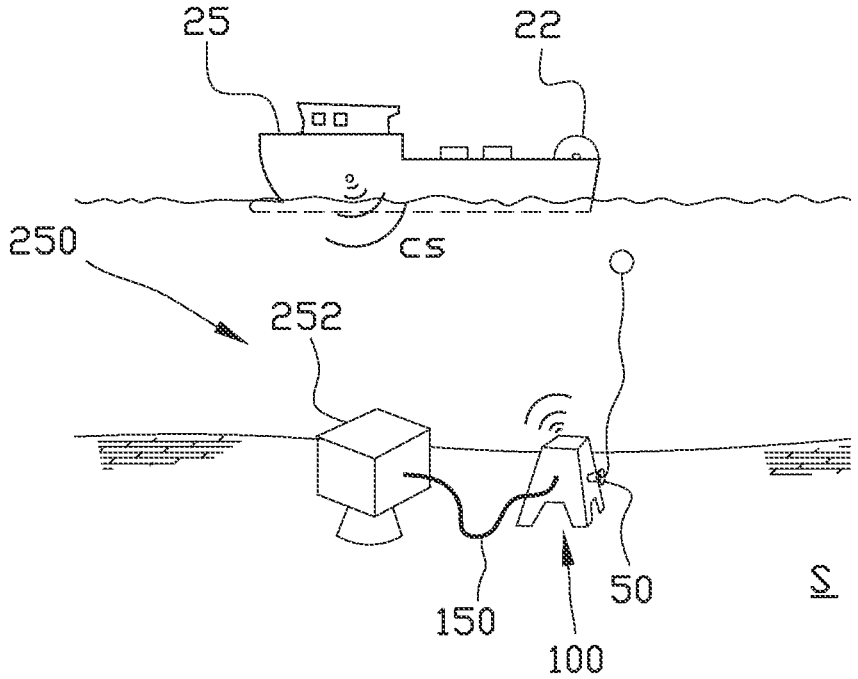
Figure 3C:
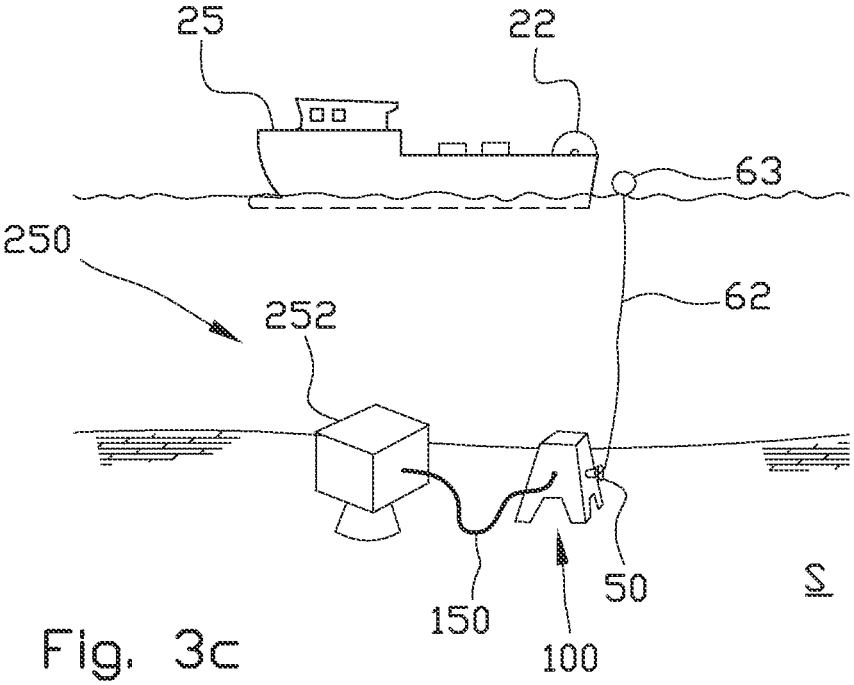

In FIG. 3*b*, a control signal CS is communicated from the floating vessel 25 to a received in a control system operatively connected to the winch 60 in a way and by means of equipment known per se. The winch 60 is activated to unwind guiding line 62, and the buoy 63 pulls the guiding line 62 unwound from the winch 60 towards a surface of the sea, until the buoy arrives at the surface of the sea, as illustrated in FIG. 3*c*.

Figure 3D:
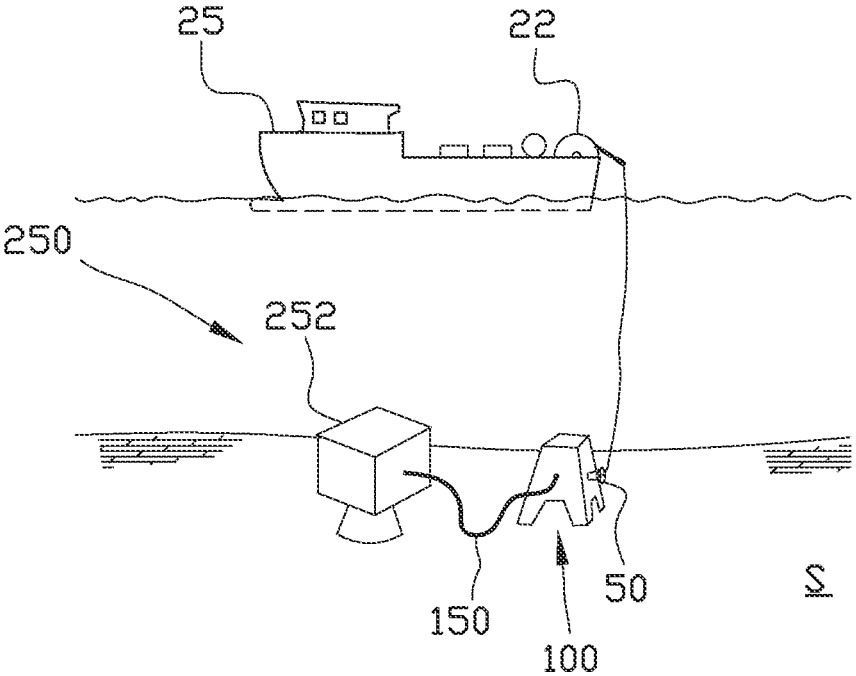
Figure 3E:
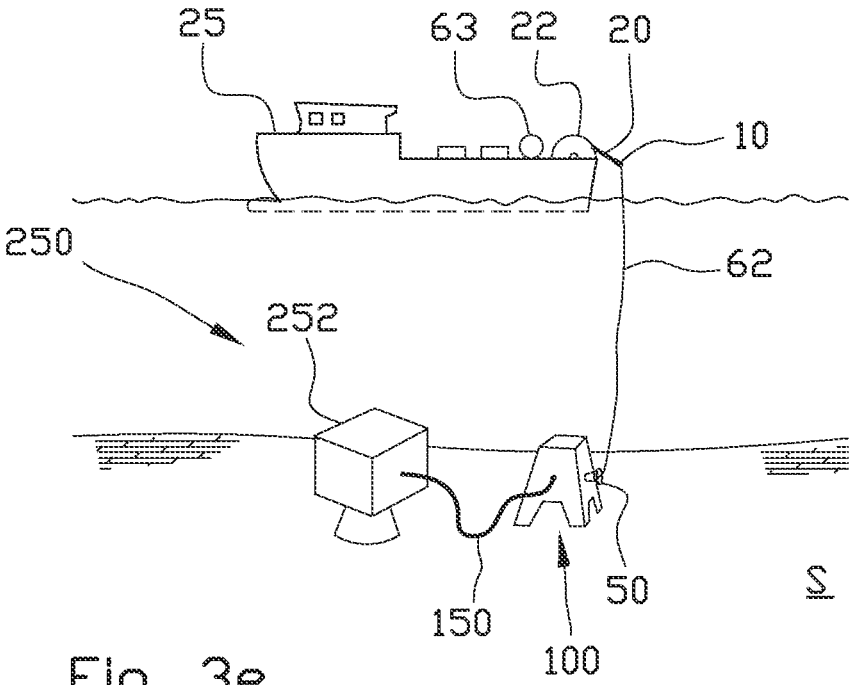

In FIG. 3*e*, the buoy 63 has been disconnected from the second end portion of the guiding line 62, and connected to the male stab 10 of the hose 20 initially stored on the spool 22 of the vessel 25. Thus, the winch 60 of the subsea fluid transfer unit 100 is operatively connected to the male stab 10 by means of the guiding line 62.

Figure 3F:
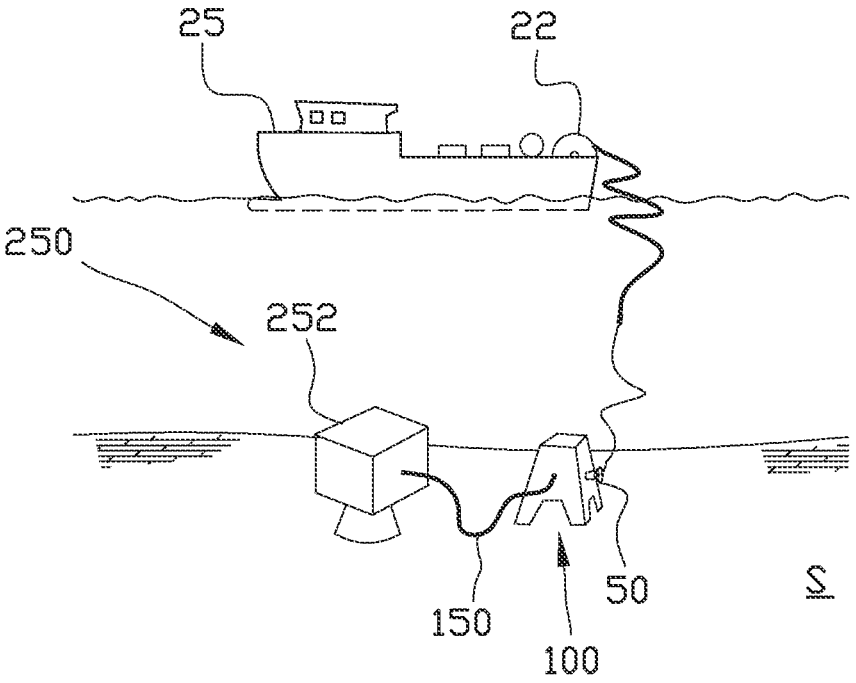
Figure 3G:
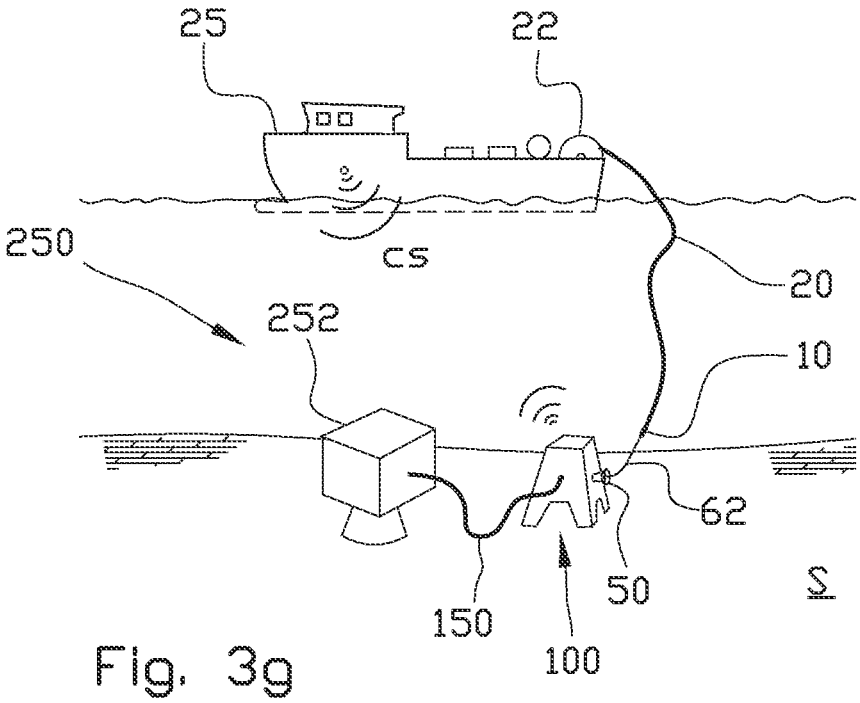

In FIG. 3*f*, an unspooling of the hose 20 from the spool 22 on the vessel 25, has commenced. At least after some time after commencing the unspooling of the hose 22, i.e., at least after a length of the hose 20 has been fed into the sea, a spooling of the guiding line 62 onto the winch 60 is initiated by communicating a control signal CS to the fluid control unit 100, as illustrated in FIG. 3*g*.

Figure 3H:
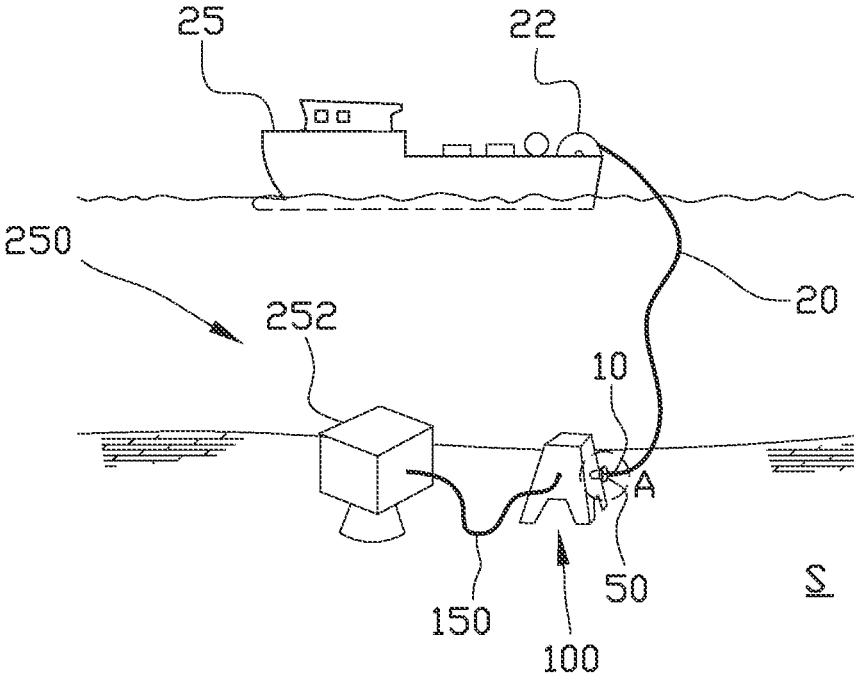
Figure 3I:
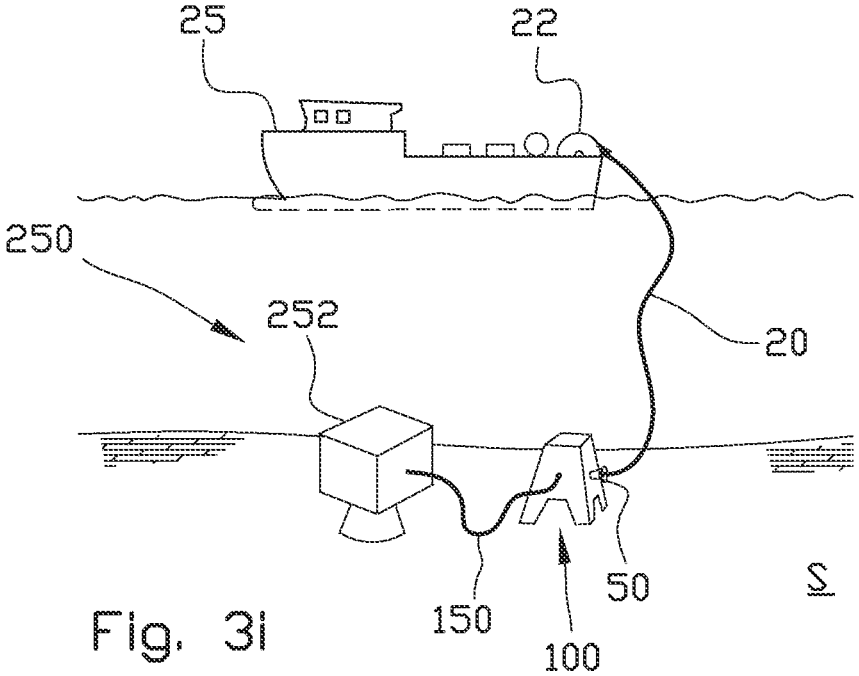
Figure 3J:
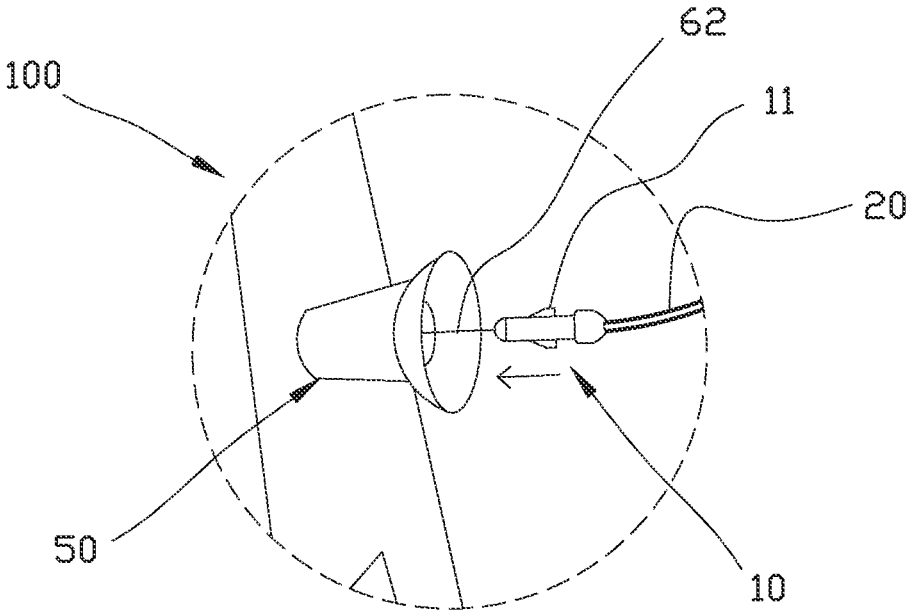
FIG. 3*j* shows in larger scale detail A in FIG. 3*i*.

Feeding the hose 20 from the spool 22 continues until the male stab 10 has been pulled into contact with the female receptacle 50 of the fluid transfer unit 100 by means of the guiding line 62 running through the female receptacle 50, as shown in FIGS. 3*h* and 3*i*. FIG. 3*j* shows in a larger scale detail A in FIG. 3*h* wherein the male stab 10 is at a position immediately before being pulled into the receptacle 50.

The male stab 10 is provided with guide bars 11 so that the male stab 10 is correctly oriented with respect to the female receptacle 50 to allow fluid communication between an aperture in the male stab 10 and a fluid pipe of the female receptacle 50. Since FIGS. 3*a*-3*j* show only principle the steps of connecting the hose 20 to the subsea installation, the aperture in the male stab 10 and the fluid pipe of the female receptacle 50, are not shown. However, the male stab 10 and the female receptacle 50 indicated in FIGS. 3*a*-3*j* may be similar to the male stab 10 and the female receptacle 50 illustrated for example in FIG. 2*a*-2*c*, although an orientation of the female 50 receptacle differs in FIG. 3*a*-3*h*.

Further, the female receptacle 50 may be operatively connected to the fluid transfer unit 100 via a gimbal being for example of a type being similar to the gimbal 56 shown in FIG. 2*a*.

The connection operation disclosed herein is close to being fully automatic, in that the only manual operations consist substantially in connecting the guiding line 62 to the male stab 10 of the hose 20 and disconnect the buoy 63 from the guiding line 62, as illustrated in FIGS. 3*c* and 3*d*. Thus, no time consuming ROV-operation is needed, and the operation can be carried out independently of a weather window.

After completing for example a well stimulation, the valves of the male stab 10 and the female receptacle 50 are closed, and the male stab 10 is released from its connection with the female receptacle 50. Thereafter, the winch 60 of the fluid transfer unit 100 is activated to unspool the guiding line 62 from the winch 60, while at the same time the spool 22 on the floating vessel 25 is activated to spool the hose 20 onto the spool 22. Thus, the second end portion of the guiding line 62 is brought to surface together with the male stab 10. This serves two purposes. Firstly, for example after completing injection of stimulation fluid into a well, the hose 20 may be buoyant. Any disconnect of the guiding line 62 would then result in an uncontrolled rising of the hose 20, representing a risk of damaging the hose 20 for example by the propellers of the floating vessel 25, while at the same time resulting in lack of desired tension in the hose 20 during spooling the hose onto the spool 22. Thus, by maintaining the connection between the male stab 10 and the guiding line 62, the hose 20 may be spooled onto the spool 22 on the floating vessel 25 in a controlled, tensioned manner. Secondly, to prepare the fluid transfer unit 100 for any subsequent operation without any need for an ROV operation, the buoy 63 should be reconnected to the second end portion of the guiding line 62 at the surface, before the guiding line 62 and the buoy 63 are brought into a position for use, i.e., a position as indicated in FIG. 3*a*.

From the above, it should be understood that the method and a system according to the present invention is suitable for providing a fluid transfer system between a floating vessel 25 and an installation 250, independently of the installation 250 being a surface installation such as ship or a rig, or a subsea installation. The fluid transfer system can be established substantially automatically and independently of a weather window, and without use of an ROV for a subsea installation. The invention therefore allows for a detailed, reliable planning substantially without considering a weather forecast, while at the same time being effective with respective to time and thereby costs for establishing the fluid communication.

In one embodiment, the method and the system further comprise an emergency quick disconnect, EQD, configured to close valves of the male stab 10 and the female receptacle prior to activating a disconnect so that any spill of fluid flowing through the system is substantially avoided.

It should be noted that the above-mentioned embodiments illustrate rather than limit the invention, and that those skilled in the art will be able to design many alternative embodiments without departing from the scope of the appended claims. In the claims, any refer ence signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The invention claimed is:

1. A method for providing fluid communicating between a floating vessel and an installation with a hose initially stored on the floating vessel, the hose having a first end provided with a male stab, a second end for connection a fluid system of the floating vessel, and a valve for controlling fluid flow through the male stab, wherein the installation comprises a fluid transfer unit provided with:

a female receptacle operatively connected to a fluid system of the installation, wherein the female receptacle comprises a valve for controlling fluid flow through the female receptacle; and a guiding line running through the female receptacle, the guiding line having a first end portion secured to a pulling device and a second end portion for connection to the male stab;

the method comprising the steps of:

A) providing connection between the second end portion guiding line and the male stab;

B) activating the pulling device to pull a portion of the guiding line through the female receptacle and bring the male stab towards the female receptacle;

C) continue pulling the guiding line through the female receptacle until the male stab connects to the female receptacle; and D) opening the valves for fluid flow to allow fluid transfer through the hose between the floating vessel and the installation.

2. The method according to claim 1, wherein the installation is a surface installation or a ship, wherein the step A) comprises:

connecting a first end portion of a pulling line to the male stab and transferring a second end portion of the pulling line to the fluid transfer unit; and connecting the second end portion of the pulling line to the guiding line.

3. The method according to claim 2, wherein the pulling line comprises a leading portion constituted by a rope, and a trailing portion, the trailing portion being connected to the male stab, the method comprises transferring the leading portion from the floating vessel to the fluid transfer unit, and transferring the trailing portion of the pulling line to the installation by pulling the leading portion of the pulling line to the fluid transfer unit.

4. The method according to claim 3, comprising disconnecting the leading portion of the pulling line from the trailing portion of the pulling line, and connecting the trailing portion of the pulling line to the guiding line.

5. The method according to claim 2, further comprising:

closing at least the valve for controlling fluid flow through the male stab;

releasing the male stab from the female receptacle;

start feeding the pulling line from the pulling device and releasing the pulling line from the guiding line; and bringing the hose back onto the floating vessel.

6. The method according to claim 1, wherein the installation is a subsea installation, the second end portion of the guiding line is connected to a buoyancy means comprises:

bringing the second end portion of the guiding line to a surface of the sea by allowing the buoyancy means to ascend to the surface;

connecting the guiding line to the male stab; and disconnecting the buoyancy means from the guiding line.

7. The method according to claim 6, wherein the pulling device is a winch, and the buoyancy means is allowed to ascend to surface by activating the winch to unspool a portion of the guiding line from the winch.

8. The method according to claim 1, further comprising:

closing at least the valve for controlling fluid flow through the male stab to prevent fluid flowing through the male stab;

releasing the male stab from the female receptacle; and bringing the hose back onto the floating vessel.

9. The method according to claim 1, wherein the method further comprising providing the female receptacle with an emergency disconnect system for disconnecting the male stab from the female receptacle.

10. The method according to claim 9, wherein the method comprises providing a sensor apparatus configured for measuring a tension between the female receptacle and the male stab to measure tension form the hose, and configuring the sensor apparatus to issue a signal to a control system operatively connected to actuators for closing the valves for controlling fluid flow through the female receptacle and the male stab, and activating disconnect means of the female receptacle and the male stab, when a tension measured by the sensor apparatus exceeds a predetermined level, whereby the male stab with the hose releases from the female receptacle.

11. A system for providing fluid communicating between a floating vessel and an installation, the installation comprising a fluid transfer unit, the system comprising:

a male stab for communicating a fluid, the male stab connected to a leading end of a hose configured for fluid communication with a fluid system on the floating vessel; and a valve for opening and closing for fluid communication through the male stab, the system further comprising:

a female receptacle operatively connected to the fluid transfer unit, wherein the female receptacle comprises a valve for controlling fluid flow through the female receptacle; and a guiding line running through the female receptacle, the guiding line having a first end portion secured to a pulling device, and a second end portion for connection to the male stab so that the male stab, when connected to the guiding line, is guided into mating contact with the female receptacle with the guiding line running through the female receptacle.

12. The system according to claim 11, wherein an end portion of the male stab is provided with a quick release configured for disconnect from the end portion of the male stab in a controlled disconnect, the quick release further comprising a quick release connector for connecting to an end portion of the guiding line, the quick release connector being configured for disconnect from the quick release in an emergency situation so that the guiding line is disconnected from the quick release and the male stab when the quick release connector is activated to disconnect.

13. The system according claim 11, wherein the second end portion of the guiding line is connected to the male stab with a pulling line.

14. The system according to claim 12, wherein the quick release is activated to disconnect from the male stab with a release actuator being responsive to an activation signal from a control system arranged in connection with the fluid transfer unit.

15. The system according to claim 14, wherein the activation signal is initiated by an operator.

16. The system according to claim 14, wherein the activation signal is provided by a sensor configured for measuring a tension between the female receptacle and the male stab to measure tension between the female receptacle and the male stab to measure tension from the hose, the sensor configured to issue a signal to the control system operatively connected to a valve actuator for closing at least the valve for controlling fluid flow through the male stab, and the release actuator for activating disconnect of the quick release connector when a tension measured by the sensor exceeds a predetermined level, whereby the quick release and male stab with the hose, releases from the quick release connector still being connected to the female receptacle.

17. The system according to claim 11, wherein the female receptacle and the male stab are provided with orientating means for axially orienting the male stab with respect to the female receptacle.

18. The system according to claim 11, wherein the female receptacle comprises a gimbal for facilitating connection between the female receptacle and the male stab when a longitudinal axis of the male stab and a longitudinal axis of the female receptacle are inclined with respect to each other.

* * * * *